US009044997B2

(12) United States Patent
Domburg et al.

(10) Patent No.: US 9,044,997 B2
(45) Date of Patent: Jun. 2, 2015

(54) ANTI-SKINNING CONTAINER INTERIOR PORTION

(75) Inventors: Stephan Domburg, Enschede (NL); George Onderdelinden, Zwolle (NL)

(73) Assignee: VALSPAR SOURCING, INC., Minneapolis, MN (US)

( * ) Notice: Subject to any disclaimer, the term of this patent is extended or adjusted under 35 U.S.C. 154(b) by 0 days.

(21) Appl. No.: 13/505,831

(22) PCT Filed: Nov. 17, 2010

(86) PCT No.: PCT/US2010/057044

§ 371 (c)(1), (2), (4) Date: Jun. 12, 2012

(87) PCT Pub. No.: WO2011/062995

PCT Pub. Date: May 26, 2011

(65) Prior Publication Data

US 2012/0241450 A1 Sep. 27, 2012

Related U.S. Application Data

(60) Provisional application No. 61/263,273, filed on Nov. 20, 2009.

(51) Int. Cl.
*B65D 51/00* (2006.01)
*B44D 3/12* (2006.01)

(52) U.S. Cl.
CPC ..... *B44D 3/127* (2013.01)

(58) Field of Classification Search
CPC ..... B44D 3/127; B65D 2543/00296; B65D 2543/00092
USPC ..... 220/200, 212, 495.02, 521, 522, 608, 220/669; 206/1.9
See application file for complete search history.

(56) References Cited

U.S. PATENT DOCUMENTS 3,434,588 A 3/1969 Kirkpatrick
(Continued)

FOREIGN PATENT DOCUMENTS

AU 2001/11205 B2 5/2003
EP 0151876 A1 12/1984
(Continued)

OTHER PUBLICATIONS

International Search Report and Written Opinion of the International Searching Authority issued May 22, 2012 for Patent Application PCT/US2010/057044, filed Nov. 17, 2010; 8 pgs.
(Continued)

*Primary Examiner* — Jeffrey Allen
*Assistant Examiner* — Madison L Poos
(74) *Attorney, Agent, or Firm* — Mueting, Raasch & Gebhardt, P.A.

(57) ABSTRACT

An interior portion of a container (e.g., a lid portion, a base portion, etc.) includes one or more walls of a body of material (e.g., in a hexagonal configuration, a spiral configuration, a concentric circular configuration, etc.) that define one or more reservoirs. The one or more reservoirs are open to receive fluid composition therein (e.g., when the lid is positioned to close the container).

38 Claims, 14 Drawing Sheets

(56) References Cited

U.S. PATENT DOCUMENTS

| | | | | |
|---|---|---|---|---|
| 4,347,948 | A | 9/1982 | Hamada et al. | |
| 4,625,883 | A | 12/1986 | Burke et al. | |
| 4,691,838 | A | 9/1987 | Graham et al. | |
| 5,249,692 | A | 10/1993 | Gunderson | |
| 5,305,909 | A | 4/1994 | Merritt | |
| 5,676,463 | A * | 10/1997 | Larsen | 366/251 |
| 6,854,617 | B2 | 2/2005 | Taylor et al. | |
| 7,093,722 | B2 * | 8/2006 | Grumbine | 210/526 |
| 2004/0062894 | A1 | 4/2004 | Van Dyk | |
| 2006/0032857 | A1 * | 2/2006 | Stensbol et al. | 220/780 |

FOREIGN PATENT DOCUMENTS

| | | | |
|---|---|---|---|
| GB | 2306429 | | 10/1995 |
| JP | 2003-072841 | A | 3/2003 |
| WO | WO00/27725 | A1 | 5/2000 |
| WO | WO2007/070971 | A1 | 6/2007 |

OTHER PUBLICATIONS

International Preliminary Report on Patentability issued May 31, 2012 for Patent Application PCT/US2010/057044, filed Nov. 17, 2010; 8 pgs.

"File: Uniform tiling 73-t12.png" Wikipedia [online], [retrieved on Sep. 24, 2009]. Retrieved from the Internet<URL: http:en.wikipedia.org/wiki/File:Uniform_tiling_73-t12.png>; 3 pgs.

"Dosing Lids—Fillon Technologies Manufacturer of equipment for the prepartion of vehic . . . " datasheet [online] Fillon Technologies, [retrieved on Sep. 24, 2009]. Retrieved from the Internet<URL:www.fillontech.eu.gb/paint-prepartion-storage/dosing-lids-fam-153.html>; 1 pg.

"Dedoes ClicSeal Alliance Mixing Lids" datasheet [online] Dedoes Industries, [retrieved on Sep. 24, 2009]. Retrieved from the Internet:<URL:www.dedoes.com/products/lids/clicsealalliance.html>; 1 pg.

* cited by examiner

ANTI-SKINNING CONTAINER INTERIOR PORTION

This application is the §371 U.S. National Stage of International Application No. PCT/US2010/057044, filed 17 Nov. 2010, which claims the benefit of U.S. Provisional Application Ser. No. 61/263,273, filed 20 Nov. 2009, each of which are incorporated by reference herein in their entireties.

BACKGROUND

The present disclosure herein relates generally to packaging of fluid compositions, e.g., paint and paint related products such as solvent-based paints and water-based paints. More particularly, the disclosure herein pertains to interior portions of containers, e.g., interior portions of lids of containers, used to hold such fluid compositions that reduce skinning.

Premature drying of compositions, e.g., paints, inside of packaging is problematic. Premature drying in packaging refers to the drying (and/or curing) of compositions inside packaging, resulting in hard particles (e.g., "skins") or at least undesirable thickening of the compositions (e.g., paint formulations) in the packaging. Such drying may be caused by factors such as increased temperature, change in temperature, and the amount of or the humidity of the air trapped inside the packaging.

Skinning refers to a specific form of premature drying where a coherent layer of a fluid composition (e.g., such as a thin layer of paint at the underside of a paint container lid) undergoes premature drying on one or more surfaces inside a package (e.g., a container, such as a 0.5, 1.0, or 2 liter paint container). Such premature drying may occur in, for example, water-based paints due to coagulation, a process in which some or all of the water and solvents evaporate and the binder particles in the paint fuse together irreversibly bound into network structures. Further, for example, premature drying may occur in solvent-based paints due to the uptake of oxygen leading to the oxidative cross-linking of the paint.

Various concepts have been discussed which attempt to prevent skinning. For example, a thin film of water or other protecting fluid on the bulk fluid in the container has been suggested for use to prevent skinning, as well as using coatings on the surfaces upon which the premature dried layer is expected to form. Further, other solutions to the skinning problem include attempting to prevent the skin which has formed from breaking off and ending up in the bulk product (e.g., bulk paint in the container). For example, use of a sharp edge on the lid that cuts the skin when the container is opened has been described.

Still further, as best understood, U.S. Patent Application Publication No. 2004/0062894 A1, published Apr. 1, 2004, entitled "Method of Packaging Solvent or Water Based Formulations to Reduce Skinning," describes a container, which is adapted to contain a water based or solvent based formulation. It is suggested that the container include a container sealing means, such as a lid, including an anti-skinning layer located on at least a portion of the internal surface thereof. The anti-skinning layer is alleged to be capable of retaining a layer of the formulation without excluding the formulation vapor in the container from contacting the formulation. Further, it is alleged that the anti-skinning layer substantially maintains the water or solvent concentration of a portion of the formulation retained on the anti-skinning layer (e.g., allegedly to prevent skinning). The anti-skinning layer described therein further is alleged to have insulative properties, e.g., to reduce the temperature differential that occurs between the lid and the body of paint or formulation.

However, there is always a need to provide alternate and/or improved techniques to prevent skinning.

SUMMARY

The disclosure herein relates generally to containers and/or lids to prevent and/or reduce skinning. Generally, the disclosure herein pertains to providing one or more interior portions of a container, e.g., interior portion of a lid, including one or more reservoirs to receive and hold fluid composition therein (e.g., as a result of the surface tension of the fluid composition, by capillary action, etc.) so as to prevent skinning.

In one or more embodiments, a container for holding a fluid composition includes a holding portion to contain a fluid composition (e.g., the fluid composition contained in the holding portion presents a fluid surface), wherein the holding portion defines an opening. Further, the container includes a lid to close the opening of the holding portion.

The lid (in combination with the holding portion or alone) may include a body of material defining one or more skinning planes, wherein the one or more skinning planes are adjacent the fluid composition when the lid is positioned to close the container. One or more reservoirs are defined by one or more walls (e.g., a polygonal wall configuration such as a hexagonal wall configuration, a spiral wall configuration, a plurality of concentric walls, a plurality of cylindrical walls, etc.) of the body of material (e.g., the one or more reservoirs and the one or more walls defining the one or more reservoirs may cover substantially the entire area of the lid exposed to the fluid composition that is generally parallel to the fluid surface when the lid is positioned to close the container). Each reservoir is open to receive and retain a portion of the fluid composition therein when the lid is positioned to close the container. Further, each wall of the one or more walls defining the one or more reservoirs includes a first wall surface portion on the one or more skinning planes exposed to the fluid composition when the lid is positioned to close the container and having a mid-point axis orthogonal to the one or more skinning planes (e.g., the first wall surface portion may be located between adjacent reservoirs or between adjacent portions of a reservoir) Each wall further includes one or more second wall surface portions that define at least a portion of the one or more reservoirs. Further, in one or more embodiments, an interior portion of the holding portion (e.g., an interior base portion) may be configured in a like manner.

The first wall surface portion on the one or more skinning planes may be defined by a first wall surface skinning distance that is less than 2 mm (i.e., the first wall surface skinning distance is a measurement of the first wall surface on the one or more skinning planes taken along a measurement plane normal to the wall and containing the mid-point axis that is orthogonal to the one or more skinning planes). Further, each of the one or more reservoirs has a reservoir depth orthogonal to the one or more skinning planes capable of holding the fluid composition, wherein the reservoir depth is greater than 1 mm.

In one or more embodiments of the lid, each of the one or more reservoirs defined by the one or more walls may have a maximum width orthogonal to the depth of the reservoir that is less than 10 mm and/or the surface area of the first wall surface portions on the one or more skinning planes may be less than 40 percent of the total area of the one or more skinning planes occupied by both the first wall surface portions and the one or more reservoirs.

Further, in one or more embodiments of the lid, each wall of the one or more walls may have a limited skinning surface located between adjacent reservoirs or adjacent portions of a reservoir that includes at least the first wall surface portion on the one or more skinning planes. The limited skinning surface is defined by a limited skinning distance that is less than 2 mm (i.e., the limited skinning distance is a measurement of the wall at a cross-section thereof taken at a depth from the skinning plane of 0.25 mm or less, wherein the measurement of the wall is taken along a measurement plane normal to the wall and containing the mid-point axis that is orthogonal to the skinning plane).

In one or more other embodiments, the lid to close the opening of the holding portion may include a body of material defining one or more skinning planes (e.g., wherein the one or more skinning planes are adjacent the fluid composition when the lid is positioned to close the container) and a plurality of reservoirs defined by a plurality of walls (e.g., a polygonal wall configuration, such a hexagonal wall configuration, or any other suitable wall structure) of the body of material. Each reservoir is enclosed by one or more walls with an open end to receive and retain a portion of the fluid composition therein when the lid is positioned to close the opening of the holding portion.

In another embodiment, a container used to hold a fluid composition is provided that includes a holding portion and a lid. The holding portion contains a fluid composition, wherein the holding portion defines an opening. The lid of the container closes the opening of the holding portion. One or more portions of at least one of the holding portion and the lid include a body of material defining one or more skinning planes, wherein the one or more skinning planes are adjacent the fluid composition when the lid is positioned to close the container. Further, the one or more portions include a plurality of reservoirs defined by a plurality of walls of the body of material, wherein each reservoir is enclosed by one or more walls with an open end to receive and retain a portion of the fluid composition.

In one or more embodiments of the container, the plurality of reservoirs and the plurality of walls defining the plurality of reservoirs cover at least a portion of the lid exposed to the fluid composition (e.g., that is generally parallel to the fluid surface when the lid is positioned to close the opening of the holding portion). In one or more other embodiments, the plurality of reservoirs and the plurality of walls defining the plurality of reservoirs cover at least an interior portion of a base portion of the holding portion (e.g., lying opposite the lid).

The above summary is not intended to describe each embodiment or every implementation of the present disclosure. A more complete understanding will become apparent and appreciated by referring to the following detailed description and claims taken in conjunction with the accompanying drawings.

Figure 1:
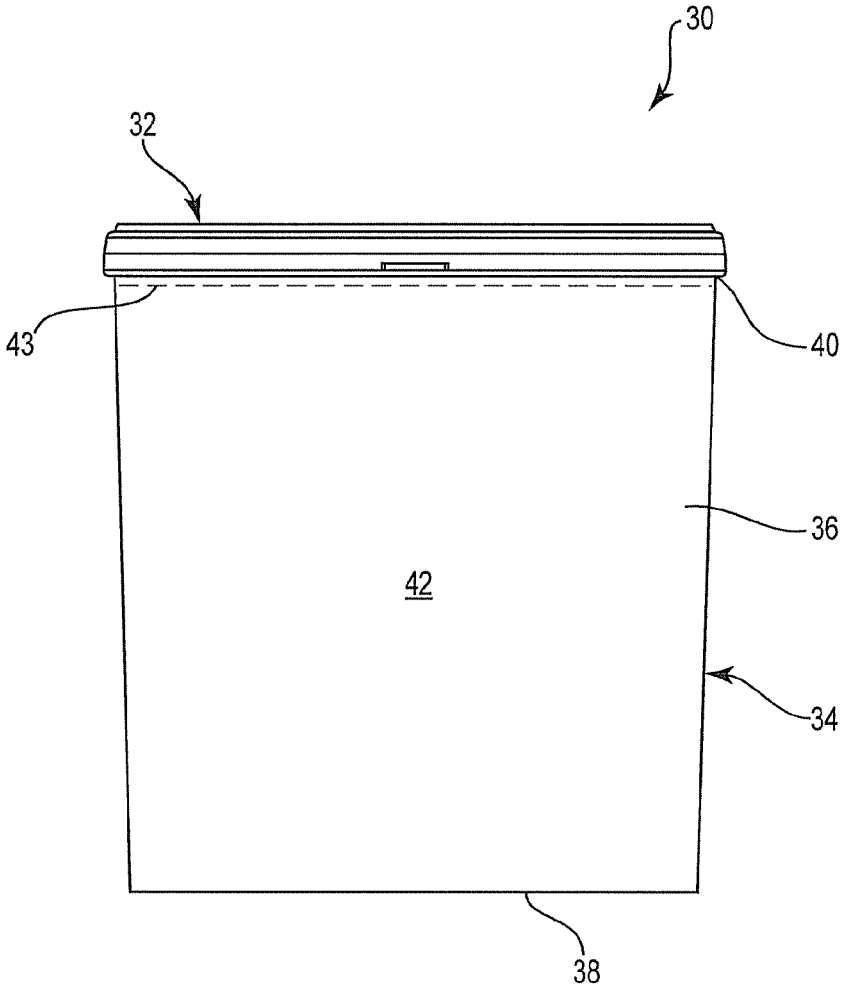
FIG. 1 is a side view of an exemplary embodiment of a container including a lid.

The figures are rendered primarily for clarity and, as a result, are not necessarily drawn to scale.

DETAILED DESCRIPTION OF EXEMPLARY EMBODIMENTS

In the following detailed description of illustrative embodiments, reference is made to the accompanying figures of the drawing which form a part hereof, and in which are shown, by way of illustration, specific embodiments which may be practiced. It is to be understood that other embodiments may be utilized and structural changes may be made without departing from the scope of the disclosure.

FIG. 1 is a side view of a container 30 including a lid 32 for closing a holding portion 34. In FIG. 1, the holding portion 34 includes a base portion 38 and one or more walls 36 extending from the base portion 38 terminating in an open end region 40 defining an opening through which the holding portion 34 may, for example, be filled. The open end region 40 (and the opening defined thereby) is closed (e.g., sealed) by lid 32. One will recognize that the holding portion 34 of the container 30 may be of any suitable configuration for holding a fluid composition 42 (e.g., the dashed line 43 illustrating a top layer or fluid surface of the fluid composition 42 adjacent the underside or bottom of lid 32). For example, the shape of the holding portion 34 may have a cross-section that is circular (e.g., a cylindrical container), elliptical, square, flexible, rigid, etc. Further, for example, the holding portion may take the form of a bottle like container including a small cap (e.g., a bottle with a neck terminating in an open end region that is smaller than the cross-section of other portions thereof). In other words, the holding portion 34 described herein is not limited to any particular configuration and may terminate at the open end region 40 in any suitable manner that engages lid 32 to close (e.g., seal) the container 30.

The container 30 may be of any suitable size. For example, the container 30 may be a 0.25 liter container, a ½ pint container, a 0.5 liter container, a pint container, a 1 liter container, a ¼ A gallon or quart container, a 2 liter container, a ½ gallon container, a 4 liter container, a gallon container, a 5 quart container, a 20 liter container (e.g., approximately 5 gallons), a 220 liter container (e.g., approximately 55 gallons), etc. However, one or more embodiments of the lids described herein may be advantageous to close any number of different sizes and shapes of containers.

The container 30 may contain any fluid composition 42, particularly those that are prone to skinning when in conventional containers. For example, the fluid composition within the container may be any water based or solvent based composition that may be prone to skinning when in conventional containers, particularly water based compositions. For example, the compositions may be various paint related products (e.g., paint colorant, paint, stain, sealants, additives, etc.). For example, the lid described herein may be beneficial for use with fluid compositions relating to a painting process. Yet further, the lid described herein may be beneficial for other types of fluid compositions (e.g., food stuffs, such as ketchup, mustard, or other condiments).

In one or more embodiments, the fluid composition, such as a paint related product, is defined by one or more characteristics, such as, viscosity, thixotropy, surface tension, density, etc. A lid as described herein may be beneficial for any fluid composition, but may be particularly advantageous for fluid compositions having a viscosity of 1.0 centipoise (cP) or more at room temperature, having a viscosity of 0.7 cP or more at room temperature, having a viscosity of 50,000 cP or less at room temperature, or having a viscosity of 100,000 cP or less at room temperature. For example, the viscosity of such fluid compositions may be in the range of 0.7 cP at room temperature to about 100,000 cP at room temperature, or about 1.0 cP at room temperature to about 50,000 cP at room temperature.

Further, in one or more embodiments, the lid as described herein may be particularly advantageous for fluid compositions having a density of at least 500 $kg/m^3$, having a density of at least 900 $kg/m^3$, having a density less than 1500 $kg/m^3$, or having a density less than 1200 $kg/m^3$. For example, the viscosity of such fluid compositions may be in the range of 500 $kg/m^3$ to 1500 $kg/m^3$ or in the range of 900 $kg/m^3$ to 1200 $kg/m^3$.

Further, in one or more embodiments, the lid as described herein may be particularly advantageous for fluid compositions having particular thixotropic characteristics. Thixotropy is the time-dependent change in viscosity of a fluid under the influence of shear stress; the longer the fluid undergoes shear stress, the lower its viscosity. Certain thixotropic properties of paint formulations help the paint formulations flow in the reservoirs more easily, while coming out less easy after coming to rest.

Further, in one or more embodiments, the lid as described herein may be particularly advantageous for fluid compositions having a liquid-air surface tension of at least 1 millinewton/meter (mN/m), having a liquid-air surface tension of at least 15 mN/m, having a liquid-air surface tension less than 50 mN/m, or having a liquid-air surface tension less than 75 mN/m. For example, the liquid-air surface tension of such fluid compositions may be in the range of 1 mN/m to 75 mN/m, or in the range of 15 mN/m to 50 mN/m.

Figure 2:
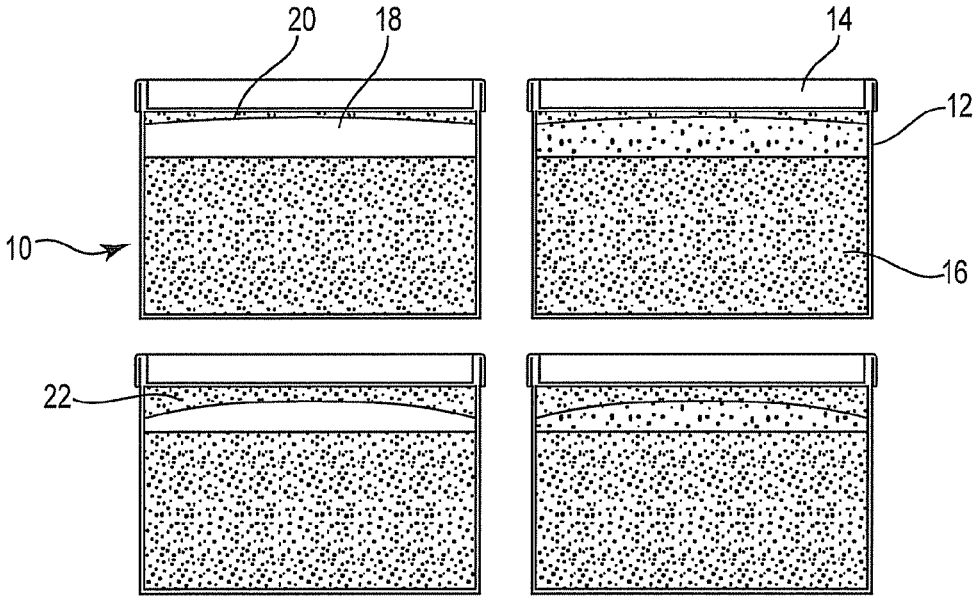
FIG. 2 illustrates a possible cause of skinning and a concept to prevent and/or reduce such skinning.

While not being bound by any particular theory, FIG. 2 illustrates one or more possible principles underlying the disclosure provided herein with respect to skinning on the underside of a lid of a container. For example, a schematic view of four cross-sections of a container 10 (i.e., having a fluid holding portion 12 and a lid 14) is shown in FIG. 2. The container 10 is filled with, for example, paint 16, and some air is present in the ullage 18 (i.e., the unfilled space in a container of fluid, often referred to as headspace). The paint, for example, solvents (e.g., mostly water in case of water based paints) are represented by the dots. The upper left container shows the situation directly after the container 10 has been filled and which has a small film 20 on the bottom or underside of the lid 14, while the lower left container shows a similar container which has a larger film 22 of paint on the bottom of the lid 14.

Directly after the container is filled and closed, a physical reaction between the paint and the ullage air occurs. Solvents from within the paint are moving out of the paint into the air in the ullage. This occurs at the areas in direct contact with the ullage (i.e., the top area of the bulk paint and the bottom area of the paint at the lid). Meanwhile, the solvent concentrations within the bulk paint are more or less homogenous (i.e., meaning solvent from the lower layers of paint in the bulk is moving upwards). At a certain point in time, the air in the ullage is saturated and moving of the solvent stops; a balance is reached.

A thin film of paint like that on the lid shown in the upper left view does not have lower layers like the bulk paint, and as such, the thin film's concentration of solvents will decrease more rapidly than that of the bulk. In some cases, as is shown in the top right view of FIG. 2, all solvents have moved out of the thin film of paint on the lid. This results in skinning, or, in other words, a dried layer of product on the underside of the lid. When the layer of paint is thicker, however, a balance in the ullage is reached before the paint of the thick film on the lid is completely dried out, preventing the premature drying of the thick film as shown by the lower right view in FIG. 2.

In view thereof, at least in one theory, increasing the volume of paint on the underside of the lid can be used to prevent premature drying or skinning. At least in one or more embodiments, the one or more reservoirs as described herein provide the volume of fluid on the underside of a lid necessary to prevent and/or at least reduce skinning.

Figure 3A:
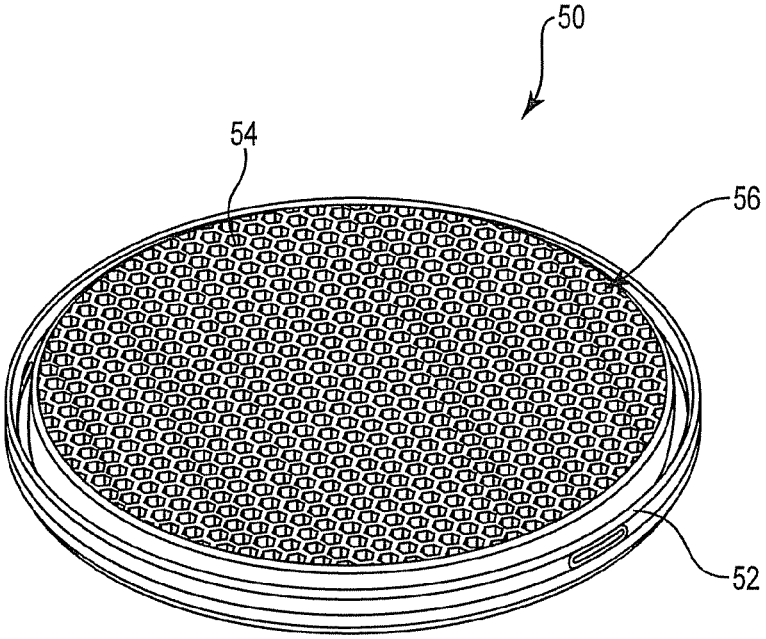
FIG. 3A is an isometric view of the bottom or underside of an exemplary lid of a container such as that shown in FIG. 1.

An isometric view of the bottom or underside of one exemplary embodiment of an interior portion of a lid 50 of a container (e.g., such as the container 30 used to hold a fluid composition 42 shown in FIG. 1) is provided in FIG. 3A, and is further shown in detail in FIGS. 4A-4E. Generally, the lid 50 is configured to seal the opening of a holding portion (e.g., such as the opening defined by the open end region 40 terminating the walls 36 of the container holding portion 34 shown in FIG. 1).

Figure 4C:
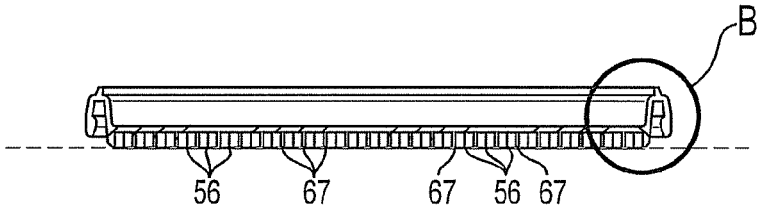
FIGS. 4A-4E are a bottom view, a side view, cross-section view taken at line A-A of FIG. 4A, a more detailed view of a portion C of the bottom view, and a more detailed view of a portion B of the cross-section view of FIG. 4B, respectively, of the lid shown in FIG. 3A.
Figure 4A:
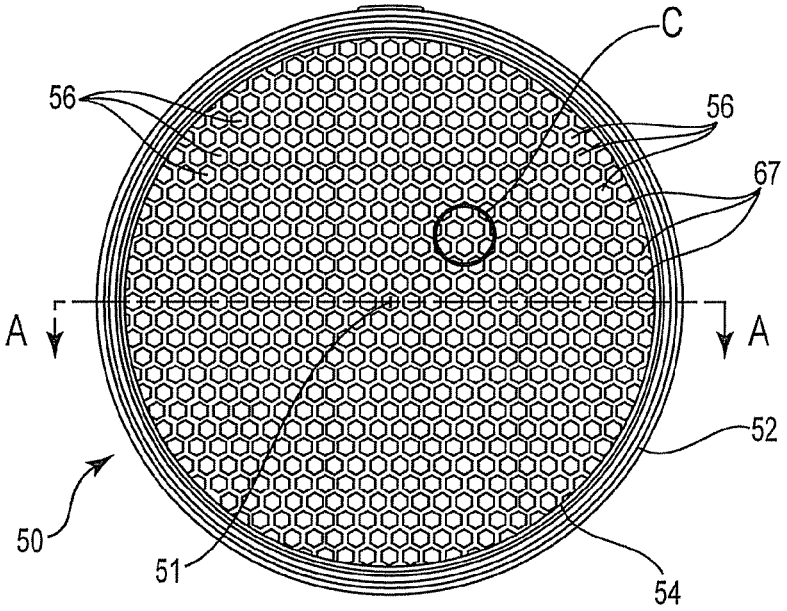
Figure 4B:
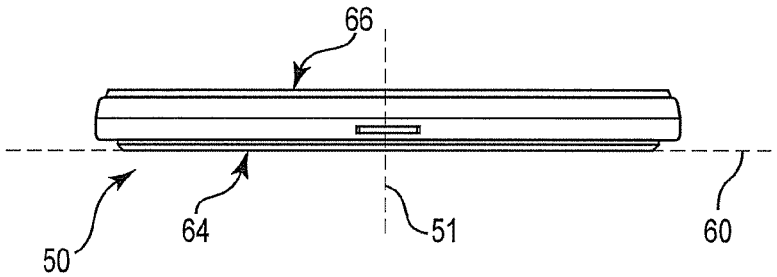
Figure 4D:
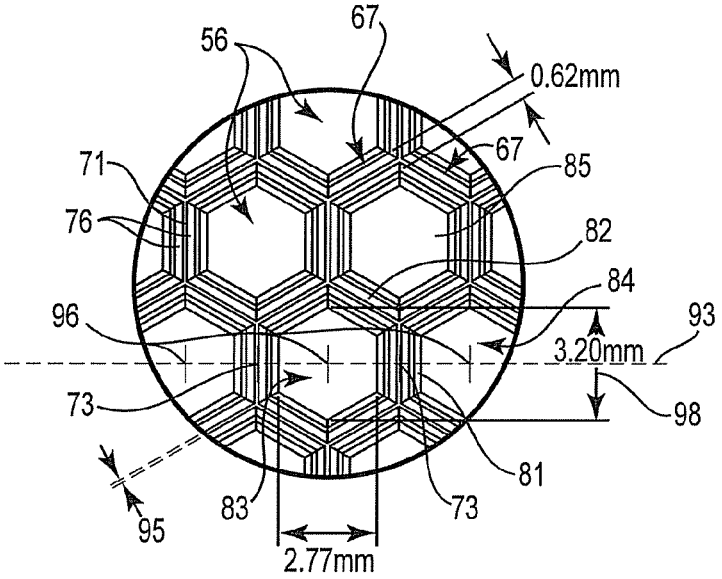
Figure 4E:
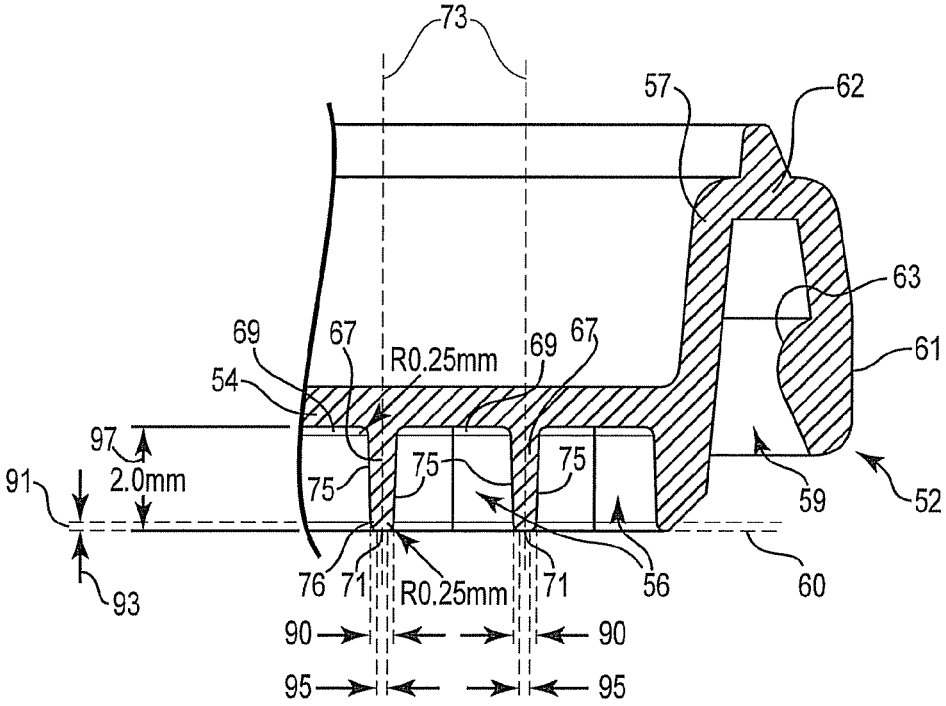

As shown in FIG. 3A, for example, lid 50 includes an engagement sealing portion 52 used to engage a sealing portion of a container (e.g., such as the open end region 40 terminating the walls 36 of the container holding portion 34 shown in FIG. 1) to seal the container. For example, as shown in FIGS. 3A and 4A, the engagement portion 52 extends about the perimeter (e.g., circumference) of the lid 50. Further, in one or more embodiments as shown in FIG. 4E, the engagement sealing portion 52 includes an inner wall member 57 (e.g., which generally is provided about the circumference of the lid 50 at a distance from a central axis 51 (e.g., an axis orthogonal to the generally planar nature of the lid 50) and an outer wall member 61 which generally is also provided about the circumference of the lid 50 at a distance from the central axis 51 that is greater than the distance of wall inner member 57 from the axis 51. The inner wall member 57 is connected to the outer wall member 61 in the connection region 62 at ends of the respective members resulting in a holding portion receiving gap or opening 59 (e.g., an annular opening) configured to receive a part of a holding portion corresponding thereto (e.g., configured to receive the annular open end region 40 terminating the walls 36 of the container holding portion 34 such as shown in FIG. 1). For example, the receiving gap 59 is sized and configured to received an open end region of a holding portion and seal it after filled, partially or entirely, with a fluid composition. In one or more embodiments, the gap 59 is defined by surfaces of inner and outer wall members 57, 61 that engage the open end region and seal the opening of a holding portion defined thereby (e.g., using one or more protrusions 63 or structure, either defined by the surfaces of the inner and outer wall members 57, 61, or, other structure defined on the holding portion).

The engagement between the lid 50 and the holding portion to seal the open end region of the holding portion may be provided by any suitable structure and is not limited to the structures represented herein. For example, as opposed to a snap fit, such as with use of engagement sealing portion 52, other engagement mechanisms may be used to provide sealing of the opening to be closed. For example, structure providing an interference fit may be used, threaded portions may be used, clip structures for connecting the lid to the holding container may be used, one or more surfaces for adhesive may be provided, etc.

Regardless of the type of engagement used to seal the opening of the holding portion, an underside portion 64 (which may also be referred to as a bottom or lower portion) of the lid 50, e.g., an interior portion of the container, is positioned adjacent the fluid composition when the lid 50 is positioned to close the holding portion (e.g., such as adjacent the fluid composition 42 if used to close holding portion 34 of container 30 as shown in FIG. 1). The underside portion 64 (e.g., which is located in the interior of the container when the container is closed) is opposite the upper or exterior portion 66 (e.g., which is on the exterior of the container when the container is closed). The upper or exterior portion 66 may be of any configuration, and, for example, may include a surface or structure that labels a product (e.g., paint labeling indicia on the surface, ink or laser printed surfaces, etc.), may include structure for stability purposes (e.g., to prevent warping of the lid), etc.

The underside portion 64 (e.g., interior portion) and the upper or exterior portion 66 may be provided by a body of material 54 (e.g., one or more materials may be provided to form such portions, such portions may be provided by a body of material that also provides engagement sealing portion 52, such portions may be formed integrally together with or without the engagement sealing portion 52, separate portions of the body of material may be connected to form the underside portion 64 and the upper or exterior portion 66 with or without the engagement sealing portion, etc.).

The body of material 54 defines one or more skinning planes 60. The one or more skinning planes 60 are adjacent the fluid composition 42 when the lid 50 is positioned to close the container (e.g., container 30 as shown in FIG. 1), and at least in one embodiment, are generally planar to the fluid surface 43 of the fluid composition 42 in the holding portion 34. One or more reservoirs 56 (e.g., a plurality of hexagon shaped reservoirs, such as, defined in a honeycomb wall type structure) are defined by one or more walls 67 of the body of material 54. At least in one embodiment, each reservoir is capable of retaining a portion of fluid composition therein (e.g., each separate reservoir being defined by walls and a base defining a volume therein, and also including an open end into which the fluid composition may flow). Generally, a honeycomb configuration of the reservoirs minimizes the surface area of a plane, e.g., the surface area lying on the one or more skinning planes that may be prone to skinning. In one or more embodiments, each reservoir is open to receive and retain a portion of the fluid composition 42 therein (e.g., by surface tension, by capillary action, splashing, flowing, etc.) when the lid 50 is positioned to close the container.

While FIG. 3A shows a honeycomb wall type structure forming a plurality of hexagonal shaped reservoirs (e.g., reservoirs having a hexagonal cross-section orthogonal to the depth of the reservoir), other various shapes for the reservoirs or the wall structures may be used. For example, any wall structure enclosing or defining a volume (e.g., reservoir) and an open end for receiving fluid composition therein may be used. For example, the wall structure may include one or more curved and/or linear portions (e.g., a cross section thereof orthogonal to the depth may be a closed path including one or more curved and/or linear segments). For example, any polygonal wall configuration may be used to provide a polygonal cross-section shaped reservoir (e.g., a reservoir enclosed by side walls and a base, and further having an open end). For example, any regular polygonal wall configuration, such as, pentagonal, square, octagonal or any other regular polygon configurations may be used. In other words, various configurations may be used to define the reservoirs and the disclosure herein is not limited to only those listed (e.g., various other uniform tiling configurations may be used including octagons, star shaped configurations, triangular configurations, etc.). Further, the size and shape of the reservoirs does not need to be uniform over the entire area prone to skinning. In other words, a mixture of reservoir types or wall configurations may be used to provide the benefits as described herein.

Figure 3B:
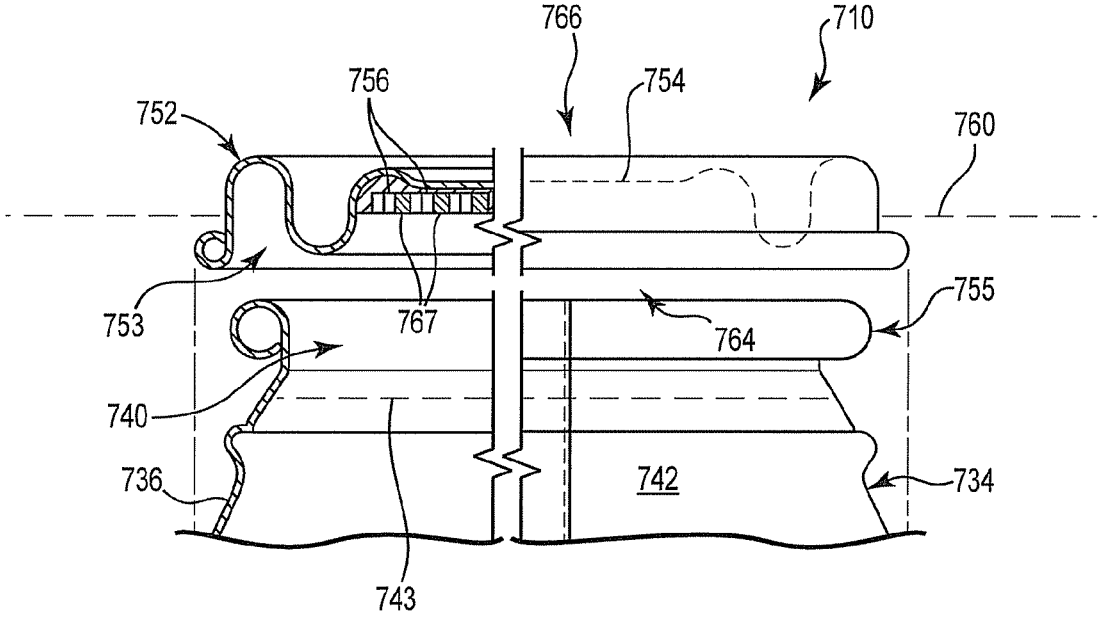
FIG. 3B is a partial cut away view of another exemplary lid, e.g., a metal lid, of another container.
Figure 3C:
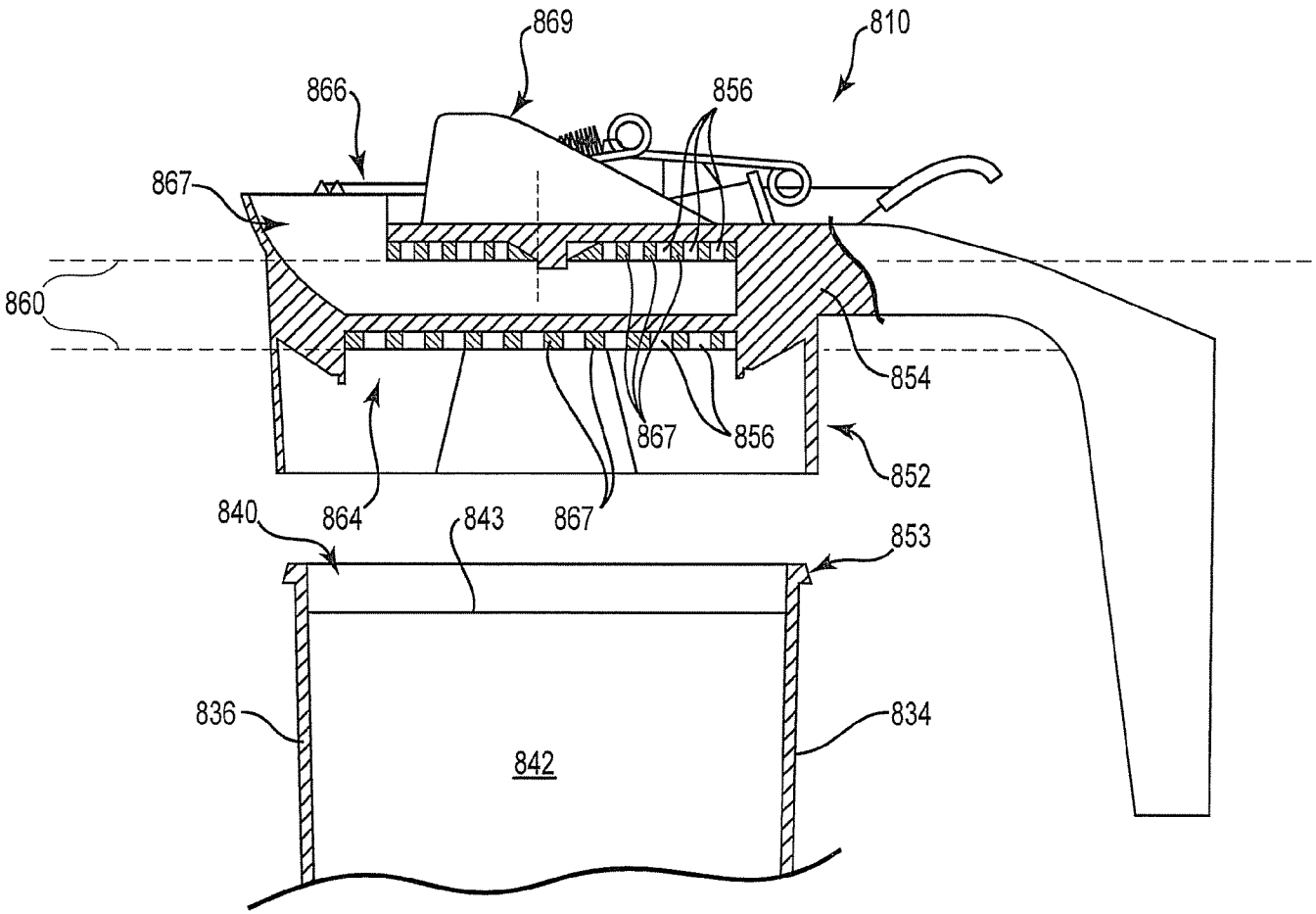
FIG. 3C is a cross section view of yet another exemplary lid, e.g., a pouring/mixing lid, of a container.

FIG. 3B and FIG. 3C show other exemplary alternate embodiments of lids for which reservoirs as described herein provide benefit. For example, a cut away view of a metal lid 710 is shown in FIG. 3B. The metal lid 710 may, for example, include an engagement sealing portion 752 (e.g., a "bug") used to engage a sealing portion 755 of a container (e.g., such as the open end region 740 terminating the walls 736 of the container holding portion 734 shown in FIG. 3B) to seal the container. For example, as shown in FIG. 3B, the engagement portion 752 includes a U-shaped element 753 that extends about the perimeter (e.g., circumference) of the lid 710 to engage with a sealing portion 755 defined at the open end region 740 of the holding portion 734 (e.g., providing an interference fit to seal the open end).

The lid 710 includes an underside portion 764 (which may also be referred to as a bottom or lower portion) of the lid 710 that is positioned adjacent the fluid composition when the lid 710 is positioned to close the holding portion 734. The underside portion 764 (e.g., which is located in the interior of the container when the container is closed) is opposite the upper or exterior portion 766 (e.g., which is on the exterior of the container when the container is closed). The underside portion 764 and the upper or exterior portion 766 may be provided by a body of material 754 that defines one or more skinning planes 760. The one or more skinning planes 760 are adjacent the fluid composition 742 when the lid 710 is positioned to close the container, and at least in one embodiment, are generally planar to the fluid surface 743 of the fluid composition 742 in the holding portion 734. One or more reservoirs 756 (e.g., a plurality of hexagon shaped reservoirs, such as, defined in a honeycomb wall type structure) are defined by one or more walls 767 of the body of material 754.

Further, for example, a cross-section of a mixing/pouring lid 810 is shown in FIG. 3C. The lid 810 may, for example, include an engagement sealing portion 852 used to engage a sealing portion 853 of a container (e.g., such as the open end region 840 terminating the walls 836 of the container holding portion 834 shown in FIG. 3C) to seal the container. The lid 810 includes an underside portion 864 (which may also be referred to as a bottom or lower portion) of the lid 810 that is positioned adjacent the fluid composition when the lid 810 is positioned to close the holding portion 834. The underside portion 864 (e.g., which is located in the interior of the container when the container is closed) is opposite the upper or exterior portion 866 (e.g., which is on the exterior of the container when the container is closed). The upper portion 866 provides a spout or pouring portion 867 capped by a locking portion 869 which seals the spout portion 867.

The underside portion 864 and the upper or exterior portion 866 may be provided by one or more bodies of material 854 that define one or more skinning planes 860. In other words, at least in this embodiment, the multiple skinning planes are parallel to one another and also generally parallel to the fluid surface 843 of the fluid composition 842 in the holding portion 834. The one or more skinning planes 860 are adjacent the fluid composition 842 when the lid 810 is positioned to close the holding portion 834 of the container. One or more reservoirs 856 (e.g., a plurality of hexagon shaped reservoirs, such as, defined in a honeycomb wall type structure) are defined by one or more walls 867 of the body of material 854.

As shown in the embodiments of FIGS. 3A-3C, a single skinning plane as well as multiple skinning planes may be present where surfaces of the lid may be prone to skinning and at which the provision of one or more reservoirs as described herein may provide anti-skinning benefits. Such skinning planes are generally parallel to the fluid surface of the fluid composition held in the container when the lid is in position to close the holding portion of the container. Further, at least in one or more embodiments, as used herein, one or more skinning planes may refer to one or more local skinning planes defined by the termination surfaces of walls (e.g., first wall surface portions) forming adjacent reservoirs. For example, with reference to FIGS. 3A and 4A-4E, the one or more skinning planes 60 may be include multiple localized skinning planes; each local skinning plane being a plane on which at least first wall surface portions 71 of walls 67 that define at least two adjacent reservoirs 56 lie. In other words, local skinning planes are defined by the first wall surface portions 71 of the walls 67 that define at least two adjacent reservoirs 56.

Figure 3D:
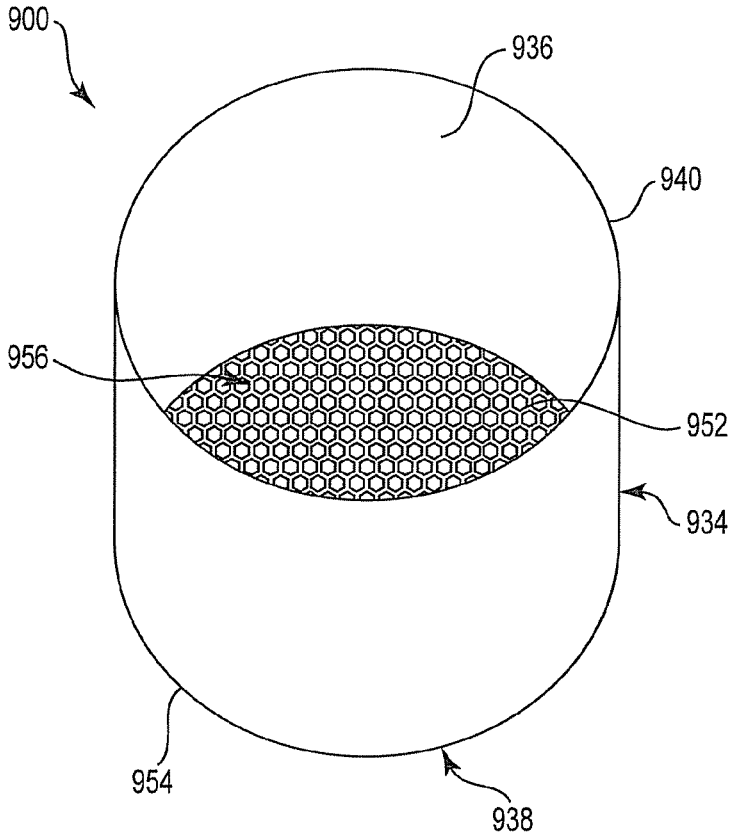
FIG. 3D is an isometric view of an exemplary holding portion of a container.

Still further, FIG. 3D shows another exemplary embodiment of an interior surface of a holding portion 934 of a container 900 (e.g., a container 900 that also may include a lid (not shown)) for which reservoirs as described herein provide benefit. For example, as shown in the isometric view of FIG. 3D, the container 900 includes the holding portion 934 which includes a base portion 938 and one or more walls 936 extending from the base portion 938 terminating in an open end region 940 defining an opening through which the holding portion 934 may, for example, be filled. The open end region 940 (and the opening defined thereby) may be closed (e.g., sealed) by a lid (not shown). One will recognize that the holding portion 934 of the container 900 may be of any suitable configuration for holding a fluid composition. For example, the shape of the holding portion 934 may have a cross-section that is circular (e.g., a cylindrical container), elliptical, square, flexible, rigid, etc. With a lid closing the opening 940, the container may be stored in one or more different manners. For example, the container may be stored upright with the lid on the top, on its side with the lid perpendicular to the ground, upside down with the base portion 938 on the top, at an angle with the lid at an angle to the ground, etc. As such, one or more interior surfaces of a holding portion of a container may benefit from the inclusion of reservoirs as described herein.

For example, although not limited thereto, as shown in the isometric view of FIG. 3D, the underside of the base portion 938 (i.e., the interior portion 952 of the base portion 938 opposite the exterior surface 954 thereof) may benefit from such reservoirs when the container 900, for example, is stored upside down with the base portion 938 on the top instead of the lid (e.g., the base portion 938 lying opposite or in opposing relation to the lid). For example, the interior portion 952 of the base portion 938 (or a portion thereof, or any other interior surface within the holding portion 934) may be provided by a body of material that defines one or more skinning planes when the container is stored in one or more different states or positions (e.g., with the base portion 938 on the top). In other words, for example, in a stored position with the base portion 938 on top, one or more skinning planes would be adjacent the fluid composition within the container 900, and at least in one embodiment, may even be generally planar to a fluid surface of a fluid composition in the holding portion 934. One or more reservoirs 956 (e.g., a plurality of hexagon shaped reservoirs, such as, defined in a honeycomb wall type structure) may be defined by one or more walls of the body of material as shown in FIG. 3D. A single skinning plane as well as multiple skinning planes may be present where interior surfaces of the container may be prone to skinning and at which the provision of one or more reservoirs as described herein may provide anti-skinning benefits. As such, any one or more interior portions may be configured with reservoirs as described herein. Further, in one or more embodiments, the one or more reservoirs may be positioned to cover substantially the entire area of the interior of the base portion 938 in a similar manner as described with reference to a lid and/or include reservoirs configured according to any reservoir configuration provided herein with reference to a lid.

When the term "generally" is used herein with other terms such as parallel or planar to describe structure or relationships of structure, one skilled in the art will recognize that certain deviations from such structure actually being planar or from such structures actually being parallel falls within the scope of such language. For example, surfaces of the lid that may be warped or have a degree of curvature due to the structure thereof (e.g., lack of sufficient strengthening material or certain structure incorporated therein) fall within the scope of such language. Further, for example, deviations of less than 20 percent fall within the scope of such language.

Although various lids and other interior surfaces may benefit from the provision of reservoirs as described herein, for simplicity, more detail with regard to the embodiment of FIGS. 3A and 4A-4E is provided than with respect to other embodiments. However, such concepts and characteristics described in detail with respect to such FIGS. 3A and 4A-4E are applicable to an underside portion of a lid of any of the lid configurations described herein and other lid configurations as would be recognized by one skilled in the art, as well as one or more other interior portions or surfaces, such as, for example, the interior of a base portion of a container as described herein.

In one or more embodiments, the one or more reservoirs 56 and the one or more walls 67 defining the one or more reservoirs 56 are positioned to cover substantially the entire area of the lid 50 exposed to the fluid composition 42 that is generally parallel to the fluid surface 43 when the lid 50 is positioned to close the container (e.g. the area of fluid composition 42 exposed at the opening defined by open end region 40 of the container holding portion 34 of FIG. 1). As used herein, to cover substantially refers to covering at least 75 percent of the area of the lid 50 exposed to the fluid composition 42 that is generally parallel to the fluid surface 43. In one or more embodiments, at least 90 percent of the area of the lid 50 exposed to the fluid composition 42 that is generally parallel to the fluid surface 43 is covered by the one or more reservoirs 56 and the one or more walls 67 defining the one or more reservoirs 56.

Each wall of the one or more walls 67 defining the one or more reservoirs 56 includes a first wall surface portion 71 on the one or more skinning planes 60. The first wall surface portion 71 has a mid-point axis 73 orthogonal to the one or more skinning planes 60 and is located between adjacent reservoirs 56 (e.g., the mid point axis may lie anywhere along the surface portion 71 between the adjacent reservoirs). For example, as shown in FIGS. 4D and 4E, the first wall surface portion 71 is a planar surface on the one or more skinning planes 60. However, in other embodiments as further described herein, the first wall surface portion may be a point or line lying on the one or more skinning planes 60 (see FIGS. 5A and 8A).

Each wall further includes one or more second wall surface portions 75 that define at least a portion of the one or more reservoirs 56. As shown in FIG. 4D, each reservoir 56 is defined by six walls (e.g., a hexagonal structure) and a base 69. Each of the six walls forming a particular reservoir separates the particular reservoir from an adjacent reservoir (e.g., wall 81 separates reservoir 83 from reservoir 84, or, in other words, wall 81 is positioned between reservoir 83 and reservoir 84; wall 82 separates reservoir 83 from reservoir 85, or, in other words, wall 82 is positioned between reservoir 83 and reservoir 85; and so forth).

The first wall surface portion 71 lying on the one or more skinning planes 60 is defined by a first wall surface skinning distance 95. The first wall surface skinning distance 95 is a measurement of the first wall surface portion 71 at the one or more skinning planes 60. The measurement of the first wall surface portion 71 is taken along a measurement plane normal to the wall 67 and containing the mid-point axis 73 that is orthogonal to the one or more skinning planes 60. In one or more embodiments, the first wall surface, skinning distance 95 is less than 2 mm. In one or more other embodiments, the first wall surface skinning distance 95 may be less than 1.5 mm, less than 1.0 mm, less than 0.7 mm, or even 0.5 mm or less.

For example, the measurement of the first wall surface portion 71 is taken along a measurement plane (e.g., measurement plane 93 that extends into the page of drawing) normal to the wall 67 and containing the mid-point axis 73 thereof that is orthogonal to the one or more skinning planes 60. In the configurations where the reservoirs 56 are symmetric and have a geometric center (e.g., center 96), the measurement of the first wall surface portion 71 to provide the first wall surface skinning distance 95 is taken along a measurement plane (e.g., measurement plane 93) normal to the wall 67 and containing not only the mid-point axis 73 thereof that is orthogonal to the one or more skinning planes 60, but also containing the geometric centers 96 of adjacent reservoirs 56.

In such a manner, with the use of the one or more reservoirs 56, a limited amount of surface area is provided at the underside portion 64 of the lid 50 that is prone to skinning. In one or more embodiments, the surface area of the first wall surface portions 71 lying on the one or more skinning planes 60 (e.g., the grid lying on the one or more skinning planes and prone to skinning) is less than 40 percent of the total area of the one or more skinning planes 60 occupied by both the first wall surface portions 71 and the one or more reservoirs 56. In one or more other embodiments, the surface area of the first wall surface portions 71 lying on the one or more skinning planes 60 is less than 30 percent of the total area of the one or more skinning planes 60 occupied by both the first wall surface portions 71 and the one or more reservoirs 56, and may even be less than 20 percent of the total area of the one or more skinning planes 60 occupied by both the first wall surface portions 71 and the one or more reservoirs 56.

Further, each wall (e.g., wall 81, 82, etc.) of the one or more walls 67 has a limited skinning surface located between adjacent reservoirs that includes at least the first wall surface portion 71. The limited skinning surface is defined by a limited skinning distance 90 that, at least in one embodiment is less than 2 mm. In one or more other embodiments, the limited skinning distance 90 may be less than less than 1.5 mm, less than 1.0 mm, less than 0.7 mm, or even 0.5 mm or less. The limited skinning distance 90 is a measurement of the wall 67 at a cross-section (e.g., cross-section 91) thereof taken at a depth 93 from the one or more skinning planes 60 of 0.25 mm or less. The measurement of the wall 67 is taken along a measurement plane (e.g., measurement plane 93 that extends into the page of drawing) normal to the wall 67 and containing the mid-point axis 73 thereof that is orthogonal to the one or more skinning planes 60. In the configurations where the reservoirs 56 are symmetric and have a geometric center (e.g., center 96), the measurement of the wall 67 to provide the limited skinning distance 71 is taken along a measurement plane (e.g., measurement plane 93) normal to the wall 67 and containing not only the mid-point axis 73 thereof that is orthogonal to the one or more skinning planes 60, but also containing the geometric centers 96 of adjacent reservoirs 56.

Further, each of the one or more reservoirs 56 has a reservoir depth 97 orthogonal to the one or more skimming planes 60 capable of holding the fluid composition. In one or more embodiments, the reservoir depth 97 is greater than 1 mm. In one or more other embodiments, the reservoir depth 97 may be greater than 1.5 mm, or greater than 1.9 mm. Although there is generally no maximum limit on the reservoir depth 97, to conserve materials used to form the lid, the reservoir depth 97, at least in one or more embodiments, is less than 10 mm, is less than 5 mm, and may even be less than 3 mm.

Still further, in one or more embodiments, each of the one or more reservoirs defined by the one or more walls 56 have a maximum width (e.g., maximum width 98 for a hexagonal reservoir as shown in FIG. 4D) orthogonal to the depth 97 of the reservoir 56 that is less than 10 mm. In one or more other embodiments, the maximum width may be less than 6 mm, less than 5 mm, or less than 4 mm.

As shown in FIG. 4E, the one or more second wall surface portions 75 that define at least a portion of the one or more reservoirs 56 include at least a rounded edge surface portion 76 adjacent the first wall surface portion 71. For example, such rounded surface portions may have a radius of about 0.25 mm; typical for a structure formed in an injection molding process. Further, such transition from the first wall surface portion 71 to the second wall surface portions 75 may be provided by a chamfered edge, or any other like transition configuration.

In one or more embodiments, such as the one described with reference to FIGS. 3 and 4A-4E, the size of the reservoirs 56 depends on the various factors including surface tension, viscosity, or, for example, the capillary action of the reservoir 56 for holding the fluid composition therein (e.g., factors may include how easy the fluid composition, such as paint, can splash or flow into the reservoirs 56, how easy the fluid composition will undesirably come out of the reservoirs due to gravitational forces, how well air inside the reservoirs escapes when fluid composition flows into the reservoirs, etc.).

For example, and without being bound by any particular theory herein, when considering the depth 97 of the reservoirs 56, such as the hexagonal reservoirs, an estimation of the theoretical maximum useful depth of the cells can be determined for particular fluid compositions based on capillary action theory.

For example, the depth or height (h) of a reservoir in which a capillary action functions to fill the reservoir and maintain the fluid composition therein is defined by:

$$h = \frac{2\gamma\cos\theta}{\rho g r}$$

where h is the height of a liquid column, γ is the liquid-air surface tension of a fluid composition, θ is the contact angle, ρ is the density of the fluid composition, g is the acceleration rate due to gravity, and r is the radius of the tube or liquid column.

For example, when taking one particular case of a paint formulation, such as one with a large surface tension value that would benefit from reduction in skinning, a depth that may be used for such a paint formulation as well as other paint formulations may be determined. For example, a paint formulation having a maximum surface tension of 0.035 $J/m^2$, a minimum contact angle of 12 degrees, and, a density of 1012 $kg/m^3$, is used, along with a gravitational force of 9.81 $m/sec^2$ and a radius of 2 mm (e.g., corresponding to a smallest circle that fits within the inside of a particular reservoir), results in such a height of approximately 3.5 mm as follows (e.g., of course this is an estimated figure since capillary action is not necessarily the only factor influencing the depth of the cell):

$$h = \frac{2(0.035)\cos(0.2094)}{(1012)(9.81)(0.002)} \approx 0.003448$$

In this particular embodiment, the calculation is based on the assumption that the hexagon reservoirs can be compared to a round hole with a diameter of 4 mm (radius of 2 mm). To determine if this diameter of 4 mm is useable in at least one embodiment, a test was performed per the following example.

The test included drilling eight holes in a PVC sheet with a depth of about 3 mm and a diameter of 3.5 mm, 4.0 mm, 4.5 mm, 5.0 mm, 5.5 mm, 6.0 mm, 6.5 mm, 7.0 mm. The holes were filled with MM942 (lead-free yellow) paint (available from Valspar Corporation). When holding the sheet upside down, only some paint from the 7 mm hole dripped out. After shaking, while holding the sheet upside-down, paint dripped out of the 5.0 mm hole and all larger holes. As such, it appears that at least for such paint, the 4.0 mm diameter and 3.0 mm depth hole and those with lesser diameter will function properly for containing the paint.

The reservoirs 56 contain a certain volume of fluid composition when a container is filled. For example, at least in one or more embodiments, less than 5 percent of the fluid composition that can be contained in the container can flow into the reservoirs 56, although not all reservoirs need be filled (e.g., in a 0.5 liter container, less than 0.025 liters is in the reservoirs). Further, for example, at least in one or more embodiments, less than 2.5 percent of the fluid composition in the container can flow into the reservoirs 56 (e.g., in a 1.0 liter container, less than 0.025 liters is in the reservoirs).

In one or more embodiments, the one or more walls 67 defining the reservoirs 56 (e.g., the honeycomb type reservoirs) are broken up along the edges as best shown in FIG. 4A (e.g., complete hexagonal reservoirs are not formed at the edges). This configuration provides a reduction in mass at the edges, as well as allowing for relatively large protrusions in a mold that may be used to form the lid without formation of plastic mass.

The following is an example illustrating a reduction in skinning for two different honeycomb lid configurations. A standard 0.5 liter plastic container was used (i.e., a container having size dimensions of 73 mm in height and approx. 106 mm in diameter, available from Valspar Corporation) which has been used to hold deBeer waterbase basecoat, such as MM942, MM922, and MM946). The lids tested were: the standard regular lid of such a container used as a reference lid; a honeycomb modified lid; and a honeycomb modified lid with rounded edges.

The honeycomb modified lid with rounded edges used is shown in the embodiment of FIGS. 3 and 4A-4E (dimensions for the modified lid are shown in the Figures, e.g., radius of rounded edges being a radius of 0.25). Further, the honeycomb modified lid without rounded edges was the same as shown in FIGS. 3 and 4A-4E, except without rounded edges (e.g., straight walls all the way to the skinning plane). To create the prototype lids, the honeycomb structure was lasered into a poly methyl methacrylate (PMMA) sheet of 2 mm material. The lasered result was then glued to the underside of the standard reference type lid.

These three lids (e.g., including the reference and two prototype lids created for test purposes, but whose structure could be provided in a variety of manners as described herein) were tested as follows. The containers were filled with 500 g of paint (i.e., de Beer water-base basecoat MM942 available from Valspar Corporation) at room temperature resulting in a distance between the surface of the bulk paint and the top of the container of approximately 11 mm. The ullage of the test containers was kept the same. The packaging was then turned upside-down and upright again and placed in an oven of 40 degrees centigrade for 3 days or 72 hours. The drying at the inner walls of the packaging and the underside of the lid were then judged. All the paint was filtered (125 micron filter) to judge the amount of residue.

The reference, predictably, showed skinning. Both the honeycomb lids had all their reservoirs filled after 72 hours in the oven. This indicated that the dimensions of the reservoirs were effective for retaining the paint therein, even though just 2 mm deep. The rounded edges had no negative effect on keeping the reservoirs filled. Both the honeycomb lids did not show a layer of paint on the whole underside of the lid, in between the reservoirs, as some of the honeycomb wall structure was visible.

When the paint was flushed away with water from the honeycomb modified lid without rounded corners, some skinning on the walls could be seen, forming a network in between the reservoirs (although skinning was reduced relative to the reference). This effect occurred even though the walls were only approximately 7 mm thick. The honeycomb modified lid with rounded corners did not show such skinning. As such, a small rounded corner at the edges of the walls (e.g., which is beneficial for the process of injection molding) does not have a negative effect on keeping the reservoirs full, but appears to have a positive influence on preventing drying at the top of the walls (e.g., on the one or more skinning planes) in between the reservoirs.

With injection molding techniques, a release draft (e.g., a taper of the walls) of typically 1 degree may be used on the walls (e.g., the ribs forming the reservoirs). This release draft may influence the properties of the reservoirs in such way, that, e.g., due to gravitational forces, fluids may be released from the reservoirs, reducing the ability to hold the fluid composition therein.

The container lid 50, or any other container lid or container portion described herein, may be formed of any one or more suitable materials, e.g., metal, polymer, paper product, and/or any other material as would be known by one skilled in the art. Although in one or more embodiments described herein the entire lid is formed of a single material, different components of the lid, or different components of the container or portions thereof, may be formed of different materials (e.g., the engagement sealing portion 52 may be formed of different material than the remainder of the lid, the reservoir side walls may be formed of a different material than the base of the reservoirs, etc.). For example, the engagement sealing portion 52 may be formed, at least in part, of metal while the remainder may be formed of plastic, the base may be formed of a first plastic material and the walls of another plastic material, etc.

In one or more embodiments, the materials used may depend on the contents retained in the container (e.g., chemical compatibility of materials used for the container lid and the contents contained therein). Further, in one or more embodiments, the lid (e.g., partially or in its entirety) may be formed of a polymer (e.g., poly vinyl chloride (PVC); polyolefin, such as, for example, polypropylene, polyethylene, such as low density polyethylene, polystyrene, etc.; polycarbonate, nylon, polyester, etc.) by molding using one or more mold forms. For example, the lid may be injection molded (e.g., using a two-piece mold), or may be milled from a plastic material (e.g., a plastic material chemically compatible with the fluid composition being held in the container). Further, for example, a single injection point in the middle of the lid may be used with multiple ejection pins being used for effective ejection of the lid (e.g., alternatively or in addition, compressed air may be used for ejection).

Further, for example, in one or more embodiments, the lid (e.g., partially or in its entirety), or the container or a portion thereof, may be formed of a metal (e.g., such as lid 710 in FIG. 3B). For example, the lid may be stamped from a sheet of metal. Although certain manufacturing processes for the lid may be advantageous, other process or material not specifically listed herein may be used as well. As such, the present disclosure is not limited to the specific methods described herein, although some may be more beneficial than others.

Figure 5A:
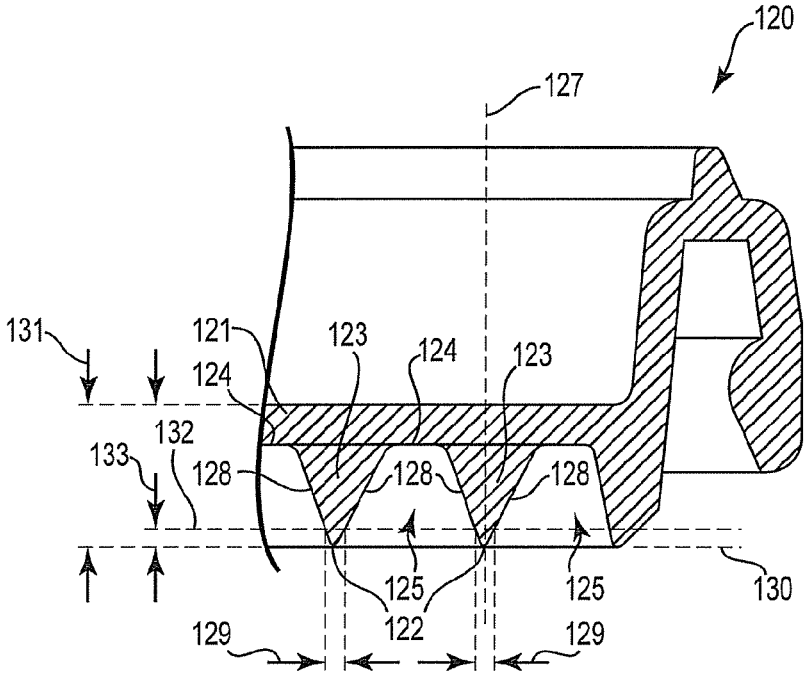
FIGS. 5A-5B are detailed portions of a cross-section view, similar to that of FIG. 4E, showing alternate embodiments of a lid.
Figure 5B:
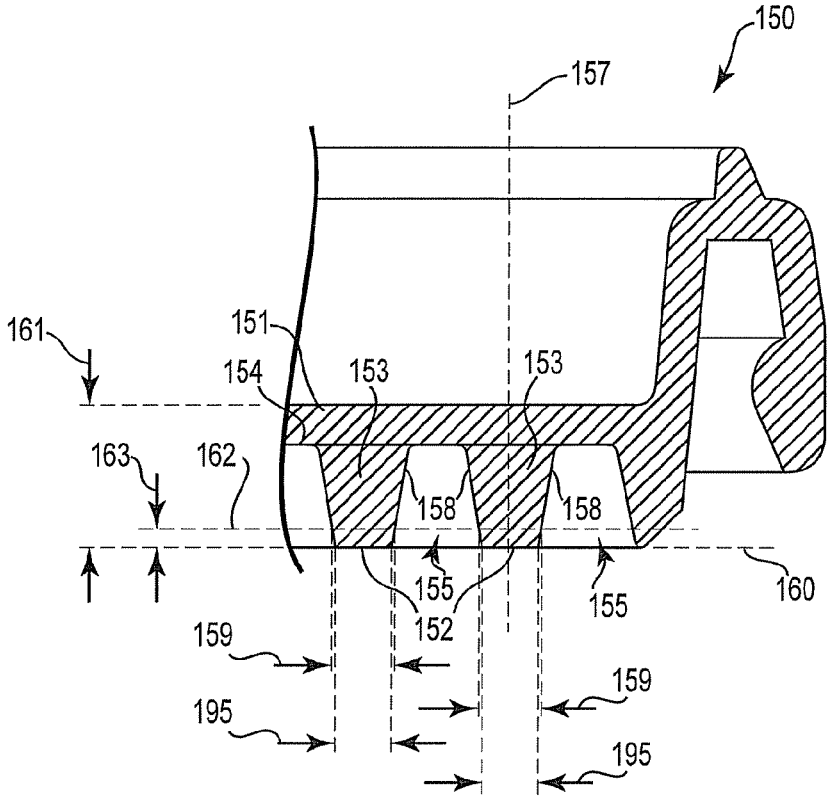

FIGS. 5A-5B are detailed portions of a cross-section view, similar to that of FIG. 4E, showing alternate embodiments of the lid 52. The lid 120 of FIG. 5A includes one or more walls 123 of a body of material 121 that define one or more reservoirs 125. Each reservoir 125 is defined by walls 123 that are tapered from a tip 122 to a base 124 located at depth 131 from the one or more skinning planes 130. In other words, the first wall surface portion on the one or more skinning planes 130 is a line (e.g., illustrated by tip 122) (and not a planar surface as shown in FIG. 4E). Further, each wall has a mid-point axis 127 orthogonal to the one or more skinning planes 130 and located between adjacent reservoirs 125.

The walls 123 shown in FIG. 5A also include the one or more second wall tapered surface portions 128 that define at least a portion of the one or more reservoirs 125. The walls 123 as shown in FIG. 5A, as well as other wall constructions described herein, may be used in one or more lid configurations (e.g., such as the hexagonal reservoirs, square or rectangular reservoirs, cylindrical reservoirs, concentric circular reservoirs, and the like, as well as a spiral reservoir as described herein).

As the first wall surface portion is tip 122 lying on the one or more skinning planes 130, the first wall surface skinning distance in this embodiment approaches zero, although a certain tip dimension may be necessary in view of the manufacturing process used to create the tip. However, in this embodiment, the first wall surface skinning distance is clearly 0.5 or less.

Further, each wall 123 has a limited skinning surface located between adjacent reservoirs 125 that includes at least the tip 122 (e.g. a line). The limited skinning surface is defined by a limited skinning distance 129 that, at least in one embodiment, is less than 2 mm. In one or more other embodiments, the limited skinning distance 129 may be less than 1.5 mm, less than 1.0 mm, less than 0.7 mm, or even be 0.5 mm or less. The limited skinning distance 129 (in a like manner as described with reference to FIGS. 4A-4E) is a measurement of the wall 123 at a cross-section (e.g., cross-section 132) thereof taken at a depth 133 from the one or more skinning planes 130 of 0.25 mm or less. The measurement of the wall 123 is taken along a measurement plane (e.g., the measurement plane being the plane of the page along which the cross-section of FIG. 5A is taken) that is normal to the wall 123 and contains the mid-point axis 127 thereof that is orthogonal to the one or more skinning planes 130.

Further, each of the one or more reservoirs 125 has the reservoir depth 131 orthogonal to the one or more skinning planes 130 capable of holding the fluid composition. In one or more embodiments, the reservoir depth 131 has the same dimensions as described with reference to the reservoir depth of the reservoirs in FIGS. 3A and 4A-4E. Still further, in one or more embodiments, each of the one or more reservoirs defined by the one or more walls 123 have a maximum width orthogonal to the depth of the reservoir 125 (e.g., between adjacent walls 128) that has the same dimensions as described with reference to the maximum width of the reservoirs in FIGS. 3A and 4A-4E.

FIG. 5A clearly shows that only tip 122 lies on the one or more skinning planes 130 (e.g., which translates into a line along the wall that lies on the one or more skinning planes 130 as viewed in a plan view as opposed to a cross-section view), and that no planar surface lies on the plane that may be prone to skinning. However, some portions of the tapered surfaces 128 that are adjacent to the tip 122 may be prone to skinning. As such, the limited skinning distance 129 defines the limited skinning surface that may be prone to skinning adjacent the one or more skinning planes 130, even though only a line lies on the one or more skinning planes 130. The depth 133 of the cross-section 132, at least in one or more embodiments, defines a limit on the surfaces extending into the reservoir that may be prone to skinning. For example, with a reservoir filled according to the disclosure provided herein, surfaces below this cross-section 132 deeper into the reservoir 125 would not be prone to skinning due, for example, to the volume of fluid composition within the reservoir.

The lid 150 of FIG. 5B includes one or more walls 153 of a body of material 151 that defines one or more reservoirs 155. Each reservoir 155 is defined by walls 153 that are tapered from a planar surface 152 to a base 154 located at depth 161 from one or more skinning planes 160. In other words, the first wall surface portion on the one or more skinning planes 160 is a planar surface 152 that is similar to that shown in FIG. 4E, except in FIG. 5B there is no rounded transition from the planar surface 152 to the tapered surfaces. Further, each wall has a mid-point axis 157 orthogonal to the one or more skinning planes 160 and located between adjacent reservoirs 155.

The walls 153 shown in FIG. 5B also include the one or more second wall tapered surface portions 158 that define at least a portion of the one or more reservoirs 155. The walls 153 as shown in FIG. 5B, as well as other wall constructions described herein, may be used in one or more lid configurations such as described herein (e.g., such as the hexagonal reservoirs, square or rectangular reservoirs, cylindrical reservoirs, concentric circular reservoirs, and the like, as well as a spiral reservoir as described herein).

The first wall surface portion or planar surface 152 lying on the one or more skinning planes 160 is defined by a first wall surface skinning distance 195. The first wall surface skinning distance 195 is a measurement of the first wall surface portion or planar surface 152 at the one or more skinning planes 160. The measurement of the first wall surface portion 152 is taken along a measurement plane normal to the wall 153 and containing the mid-point axis 157 that is orthogonal to the one or more skinning planes 160. In one or more embodiments, the first wall surface skinning distance 195 is less than 2 mm. In one or more other embodiments, the first wall surface skinning distance 195 may be less than 1.5 mm, less than 1.0 mm, less than 0.7 mm, or even 0.5 mm or less.

Further, each wall 153 has a limited skinning surface located between adjacent reservoirs 155 that includes at least the first wall surface portion 152. The limited skinning surface is defined by a limited skinning distance 159 that, at least in one embodiment, is less than 2 mm. In one or more other embodiments, the limited skinning distance 129 may be less than 1.5 mm, less than 1.0 mm, less than 0.7 mm, or even 0.5 mm or less. The limited skinning distance 159 (in a like manner as described with reference to FIGS. 4A-4E) is a measurement of the wall 153 at a cross-section (e.g., cross-section 162) thereof taken at a depth 163 from the one or more skinning planes 160 of 0.25 mm or less. The measurement of the wall 153 is taken along a measurement plane (e.g., the measurement plane being the plane of the page along which the cross-section of FIG. 5B is taken) that is normal to the wall 153 and contains the mid-point axis 157 thereof that is orthogonal to the one or more skinning planes 160.

Further, each of the one or more reservoirs 155 has the reservoir depth 161 orthogonal to the one or more skinning planes 160 capable of holding the fluid composition. In one or more embodiments, the reservoir depth 161 has the same dimensions as described with reference to the reservoir depth of the reservoirs in FIGS. 3A and 4A-4E. Still further, in one or more embodiments, each of the one or more reservoirs defined by the one or more walls 153 have a maximum width orthogonal to the depth of the reservoir 155 (e.g., between adjacent walls 158) that has the same dimensions as described with reference to the maximum width of the reservoirs in FIGS. 3A and 4A-4E.

Figure 6A:
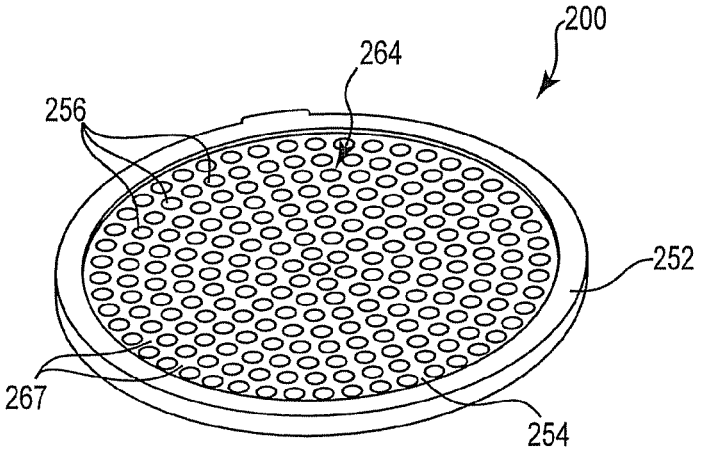
FIG. 6A is an isometric view of the bottom or underside of an alternate exemplary lid of a container such as that shown in FIG. 1.
Figure 6B:
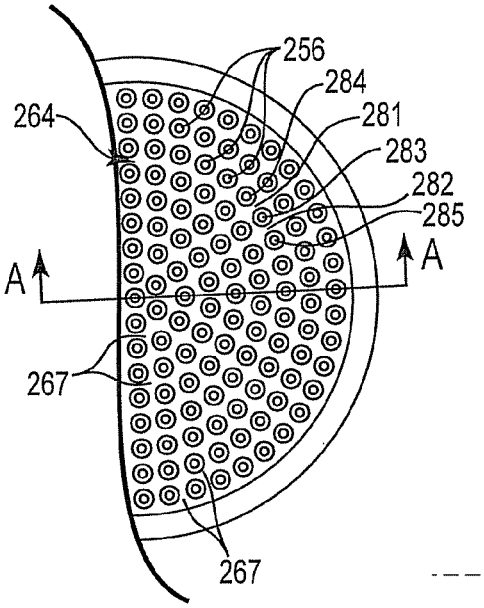
FIGS. 6B-6D are a partial bottom view, a cross-section view taken at line A-A of FIG. 6B, and a more detailed view of a portion C of the cross-section view of FIG. 6C, respectively, of the lid shown in FIG. 6A.
Figure 6C:
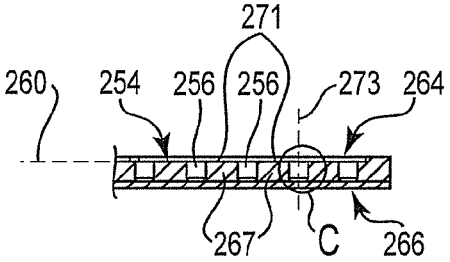
Figure 6D:
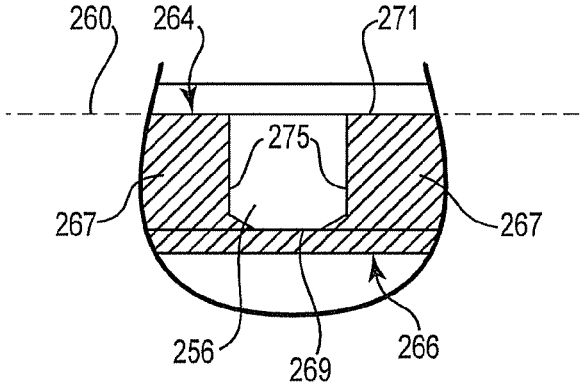

FIG. 6A is an isometric view of the bottom or underside of an alternate exemplary lid 200 of a container such as that shown in FIG. 1. FIGS. 6B-6D are a partial bottom view, a cross-section view taken at line A-A of FIG. 6B, and a more detailed view of a portion C of the cross-section view of FIG. 6C, respectively, of the lid shown in FIG. 6A. The lid 200 is configured to seal the opening of a holding portion (e.g., such as the opening defined by the open end region 40 terminating the walls 36 of the container holding portion 34 shown in FIG. 1).

As shown in FIGS. 6A-6D, for example, the lid 200 includes a generalized engagement sealing portion 252 used to engage a sealing portion of a container (e.g., such as the open end region 40 terminating the walls 36 of the container holding portion 34 shown in FIG. 1) to seal the container. As described with reference to FIGS. 3A and 4A, the engagement sealing portion 252 providing for the engagement between the lid 200 and the holding portion to seal the open end region of the holding portion may be provided by any suitable structure and therefore is only shown generally in FIGS. 6A-6D.

Regardless of the type of engagement used to seal the opening of the holding portion, an underside portion 264 (which may also be referred to as a bottom or lower portion) of the lid 200 is positioned adjacent the fluid composition when the lid 200 is positioned to close the holding portion (e.g., such as adjacent the fluid composition 42 if used to close holding portion 34 of container 30 as shown in FIG. 1). The underside portion 264 (e.g., which is located in the interior of the container when the container is closed) is opposite the upper or exterior portion 266 (e.g., which is on the exterior of the container when the container is closed).

The underside portion 264 and the upper or exterior portion 266 may be provided by a body of material 254. The body of material 254 defines one or more skinning planes 260. The one or more skinning planes 260 are adjacent the fluid composition 42 when the lid 200 is positioned to close the container (e.g., container 30 as shown in FIG. 1). One or more reservoirs 256 (e.g., a plurality of cylindrical shaped reservoirs) are defined by one or more walls 267 of the body of material 254. In one or more embodiments, each reservoir is open to receive and retain a portion of the fluid composition 42 therein when the lid 200 is positioned to close the container.

In one or more embodiments, the one or more reservoirs 256 are positioned to cover substantially the entire area of the lid 200 in a similar manner as described with reference to FIGS. 3A and 4A-4E. Each wall of the one or more walls 267 defining the one or more reservoirs 256 includes a first wall surface portion 271 on the one or more skinning planes 260 (e.g., a planar surface on the one or more skinning planes 260) and having a mid-point axis 273 orthogonal to the one or more skinning planes 260 and located between adjacent reservoirs 256. Each wall further includes one or more second wall surface portions 275 (e.g., cylindrical surfaces) that define at least a portion of the one or more reservoirs 256. As shown in FIGS. 6A-6D, each reservoir 256 is defined by a cylindrical wall surface 275 and a base 269. The walls forming the cylindrical wall surfaces 275 separate reservoirs from adjacent reservoirs (e.g., wall 281 separates reservoir 283 from reservoir 284, or, in other words, wall 281 is positioned between reservoir 283 and reservoir 284; wall 282 separates reservoir 283 from reservoir 285, or, in other words, wall 282 is positioned between reservoir 283 and reservoir 285; and so forth).

Each wall (e.g., wall 281, 282, etc.) of the one or more walls 267 has a first wall surface skinning distance that is defined in a similar manner as described with reference to FIGS. 3A and 4A-4E, and also has a limited skinning surface located between adjacent reservoirs that includes at least the first wall surface portion 271. The limited skinning surface is defined in a similar manner as described with reference to FIGS. 3A and 4A-4E. Further, each of the one or more reservoirs 256 has a reservoir depth orthogonal to the one or more skinning planes 260 capable of holding the fluid composition defined in a similar manner as described with reference to FIGS. 3A and 4A-4E. Still further, in one or more embodiments, each of the one or more reservoirs defined by the one or more walls 256 have a maximum width (e.g., a diameter of the circular cross-section of the cylindrical reservoirs). In other words, the embodiment of FIGS. 6A-6D is similar to that described with reference to FIGS. 3A and 4A-4E, except that the reservoirs are cylindrical shaped reservoirs as opposed to hexagonal shaped reservoirs.

Figure 7A:
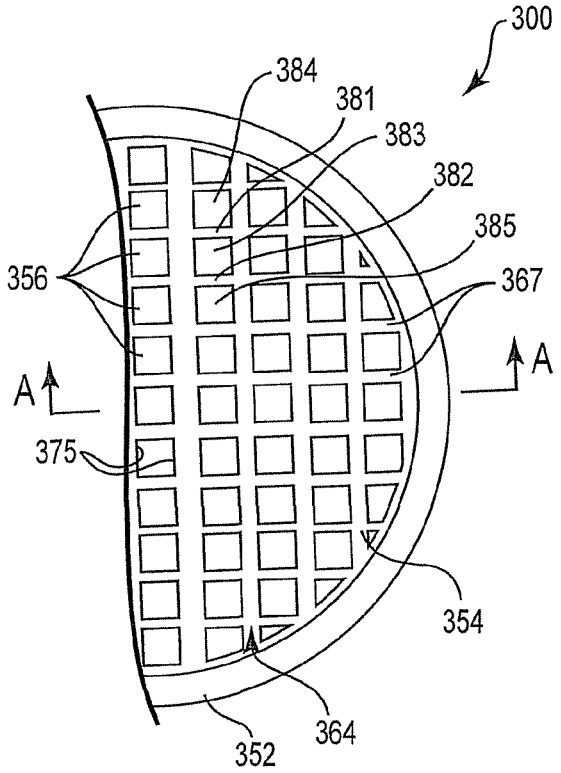
FIG. 7A is a partial bottom view of an alternate exemplary lid of a container such as that shown in FIG. 1
Figure 7B:
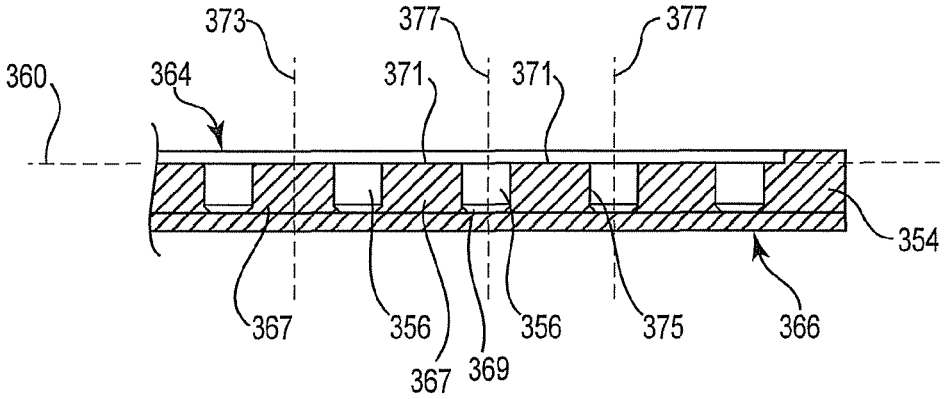
FIG. 7B is a cross-section view taken at line A-A of FIG. 7A.

FIG. 7A is a partial bottom view of an alternate exemplary lid 300 of a container such as that shown in FIG. 1 and FIG. 7B is a cross-section view taken at line A-A of FIG. 7A. The embodiment of the lid 300 shown in FIGS. 7A-7B is similar to that described with reference to FIGS. 3A and 4A-4E, except that the reservoirs are block shaped, such as with a square or rectangular opening into the reservoir as opposed to cylindrical shaped reservoirs (e.g., they have a square or rectangular cross-section parallel to the one or more skinning planes 360).

For example, the lid 300 is configured to seal the opening of a holding portion (e.g., such as the opening defined by the open end region 40 terminating the walls 36 of the container holding portion 34 shown in FIG. 1). As shown in FIGS. 7A-7B, for example, the lid 300 includes a generalized engagement sealing portion 352 used to engage a sealing portion of a container (e.g., such as the open end region 40 terminating the walls 36 of the container holding portion 34 shown in FIG. 1) to seal the container. As described with reference to FIGS. 3A and 4A, the engagement sealing portion 352 providing for the engagement between the lid 300 and the holding portion to seal the open end region of the holding portion may be provided by any suitable structure and therefore is only shown generally in FIGS. 7A-7B.

Regardless of the type of engagement used to seal the opening of the holding portion, an underside portion 364 (which may also be referred to as a bottom or lower portion) of the lid 300 is positioned adjacent the fluid composition when the lid 300 is positioned to close the holding portion (e.g., such as adjacent the fluid composition 42 if used to close holding portion 34 of container 30 as shown in FIG. 1). The underside portion 364 (e.g., which is located in the interior of the container when the container is closed) is opposite the upper or exterior portion 366 (e.g., which is on the exterior of the container when the container is closed).

The underside portion 364 and the upper or exterior portion 366 may be provided by a body of material 354. The body of material 354 defines one or more skinning planes 360. The one or more skinning planes 360 are adjacent the fluid composition 42 when the lid 300 is positioned to close the container, and generally parallel to the fluid surface of the fluid composition held in the container. One or more reservoirs 356 (e.g., a plurality of block shaped reservoirs) are defined by one or more walls 367 of the body of material 354. In one or more embodiments, each reservoir is open to receive and retain a portion of the fluid composition 42 therein when the lid 300 is positioned to close the container.

In one or more embodiments, the one or more reservoirs 356 are positioned to cover substantially the entire area of the lid 300 in a similar manner as described with reference to FIGS. 3A and 4A-4E. Each wall of the one or more walls 367 defining the one or more reservoirs 356 includes a first wall surface portion 371 on the one or more skinning planes 360 (e.g., a planar surface on the one or more skinning planes 360) and having a mid-point axis 373 orthogonal to the one or more skinning planes 360. The first wall surface portion 371 located between adjacent reservoirs 356. Each wall further includes one or more second wall surface portions 375 (e.g., planar surfaces, that may or may not be orthogonal to the one or more skinning planes) that define at least a portion of the one or more block shaped reservoirs 356 which lie along an axis 377 parallel to the axis 373. As shown in FIGS. 7A-7B, each reservoir 356 is defined by four wall surfaces and a base 369. The walls separate reservoirs from adjacent reservoirs (e.g., wall 381 separates reservoir 383 from reservoir 384, or, in other words, wall 381 is positioned between reservoir 383 and reservoir 384; wall 382 separates reservoir 283 from reservoir 285; and so forth).

Each wall (e.g., wall 381, 382, etc.) of the one or more walls 367 is defined by a first wall surface skinning distance that is defined in a similar manner as described with reference to FIGS. 3A and 4A-4E, and also has a limited skinning surface located between adjacent reservoirs that includes at least the first wall surface portion 371. The limited skinning surface is defined in a similar manner as described with reference to FIGS. 3A and 4A-4E. Further, each of the one or more reservoirs 356 has a reservoir depth orthogonal to the one or more skinning planes 360 capable of holding the fluid composition defined in a similar manner as described with reference to FIGS. 3A and 4A-4E; and a maximum width also defined in a similar manner as described with reference to FIGS. 3A and 4A-4E.

Figure 8A:
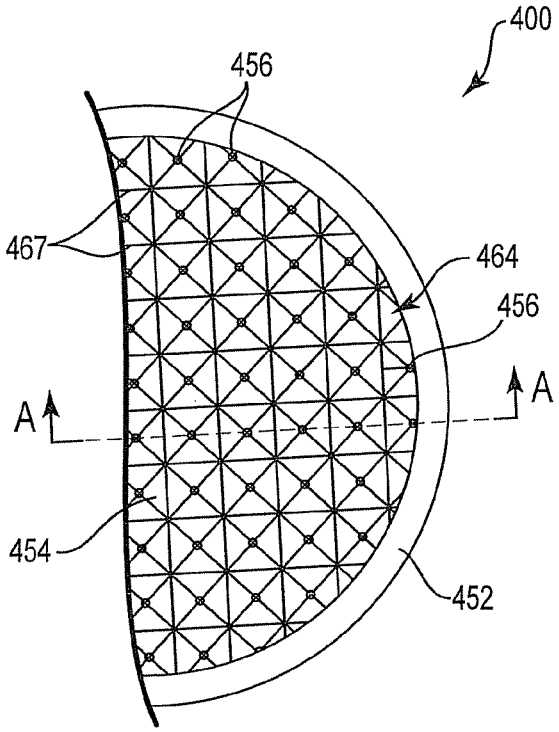
FIG. 8A is a partial bottom view of an alternate exemplary lid of a container such as that shown in FIG. 1
Figure 8B:
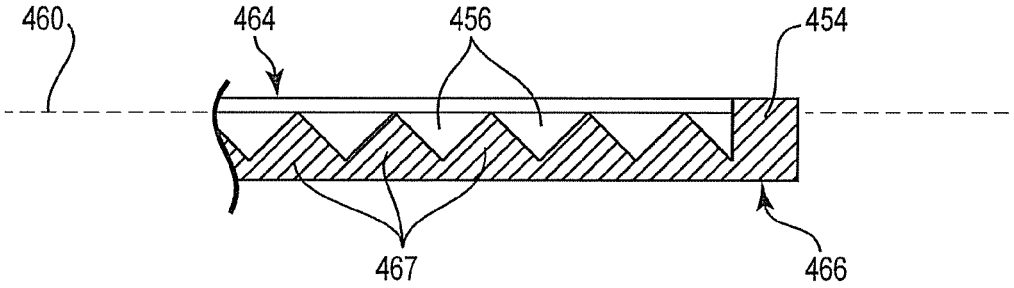
FIG. 8B is a cross-section view taken at line A-A of FIG. 8A.

FIG. 8A is a partial bottom view of an alternate exemplary lid 400 of a container such as that shown in FIG. 1 and FIG. 8B is a cross-section view taken at line A-A of FIG. 8A. The embodiment of the lid 400 shown in FIGS. 8A-8B is similar to that described with reference to FIGS. 3A and 4A-4E, except that the reservoirs are inverted pyramidal reservoirs 456 as opposed to hexagonal shaped reservoirs (e.g., the bottom of the reservoir is formed to a point or close thereto). The lid 400 includes a generalized engagement sealing portion 452. Further, an underside portion 464 (which may also be referred to as a bottom or lower portion) of the lid 400 is positioned adjacent the fluid composition when the lid 400 is positioned to close the holding portion (e.g., such as adjacent the fluid composition 42 if used to close holding portion 34 of container 30 as shown in FIG. 1). The underside portion 464 (e.g., which is located in the interior of the container when the container is closed) is opposite the upper or exterior portion 466 (e.g., which is on the exterior of the container when the container is closed).

The underside portion 464 and the upper or exterior portion 466 may be provided by a body of material 454. The body of material 454 defines one or more skinning planes 460. The one or more skinning planes 460 are adjacent the fluid composition 42 when the lid 400 is positioned to close the container. The inverted pyramidal reservoirs 456 are defined by one or more tapered walls 467 of the body of material 454. In one or more embodiments, each reservoir is open to receive and retain a portion of the fluid composition 42 therein when the lid 400 is positioned to close the container. The specific details regarding the walls and reservoirs may be discerned from the other walls and reservoirs described herein and shall not be further described in detail.

Figure 9C:
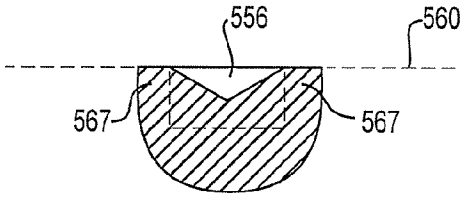
FIG. 9C is a more detailed view of a portion B of the cross-section view of FIG. 9B.
Figure 9A:
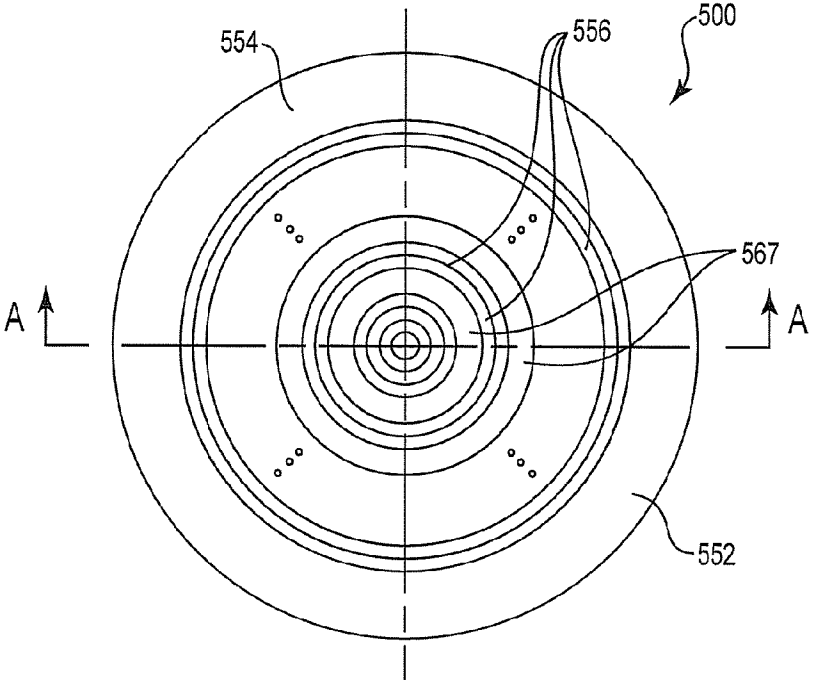
FIG. 9A is a bottom view of an alternate exemplary lid of a container such as that shown in FIG. 1.
Figure 9B:
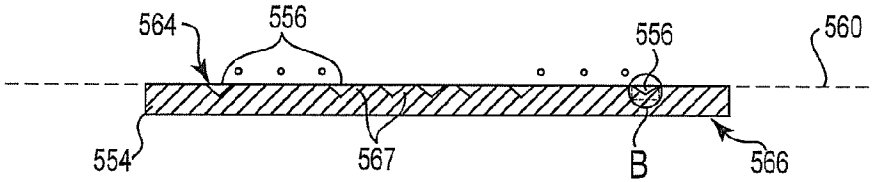
FIG. 9B is a cross-section view taken at line A-A of FIG. 9A.

FIG. 9A is a bottom view of an alternate exemplary lid 500 of a container such as that shown in FIG. 1, FIG. 9B is a cross-section view taken at line A-A of FIG. 9A, and FIG. 9C is a more detailed view of a portion of the cross-section view of FIG. 9B. The embodiment of the lid 500 shown in FIGS. 9A-9C is similar to that described with reference to FIGS. 3A and 4A-4E, except that the concentric circular shaped reservoirs are defined in the lid as opposed to hexagonal shaped reservoirs. For example, the lid 500 includes a generalized engagement sealing portion 552. Further, an underside portion 564 (which may also be referred to as a bottom or lower portion) of the lid 500 is positioned adjacent the fluid composition when the lid 500 is positioned to close the holding portion (e.g., such as adjacent the fluid composition 42 if used to close holding portion 34 of container 30 as shown in FIG.

1). The underside portion 564 (e.g., which is located in the interior of the container when the container is closed) is opposite the upper or exterior portion 566 (e.g., which is on the exterior of the container when the container is closed).

The underside portion 564 and the upper or exterior portion 566 may be provided by a body of material 554. The body of material 554 defines one or more skinning planes 560. The one or more skinning planes 560 are adjacent the fluid composition 42 when the lid 500 is positioned to close the container. One or more reservoirs 556 (e.g., a plurality of concentric circular reservoirs) are defined by one or more walls 567 of the body of material 554. In one or more embodiments, each reservoir is open to receive and retain a portion of the fluid composition 42 therein when the lid 500 is positioned to close the container. The specific details regarding the walls and reservoirs may be discerned from the other walls and reservoirs described herein and shall not be further described in detail. However, it is noted that the cross-section of the concentric circular shaped reservoirs may take any of a number of configurations, just like the other reservoirs described herein. For example, the reservoirs 556 as shown in FIG. 9C may be V-shaped as shown by the solid cross-section line forming the reservoir shape or can be square-shaped as shown by the dashed cross-section line forming the reservoir shape. One will recognize that many various cross-section shapes (e.g., both symmetric and non-symmetric) may be used as the shape of the reservoir, and that the present disclosure is not limited to only those specifically recited or listed herein. Further, it will be recognized that the actual number of concentric circular shaped reservoirs that may be defined in lid 500 is not depicted in FIG. 9A. Rather, FIG. 9A illustrates that the number of concentric circular shaped reservoirs may vary.

Figure 10A:
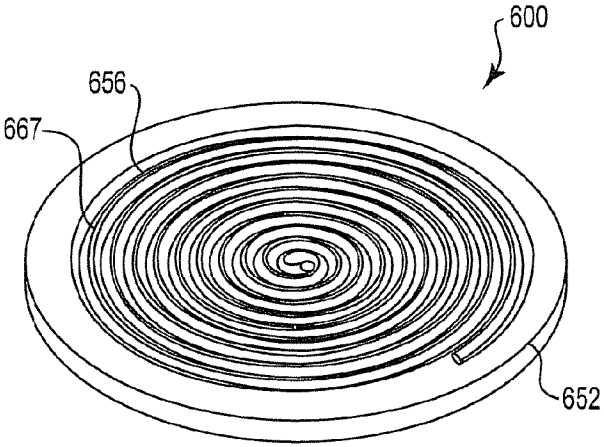
FIG. 10A is an isometric view of the bottom or underside of an alternate exemplary lid of a container such as that shown in FIG. 1.
Figure 10D:
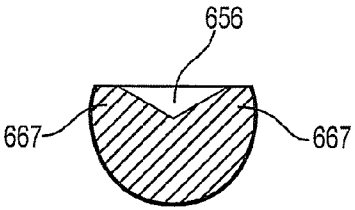
FIGS. 10B-10D are a bottom view, a cross-section view taken at line A-A of FIG. 10B, and a more detailed view of a portion B of the cross-section view of FIG. 10C, respectively, of the lid shown in FIG. 10A.
Figure 10B:
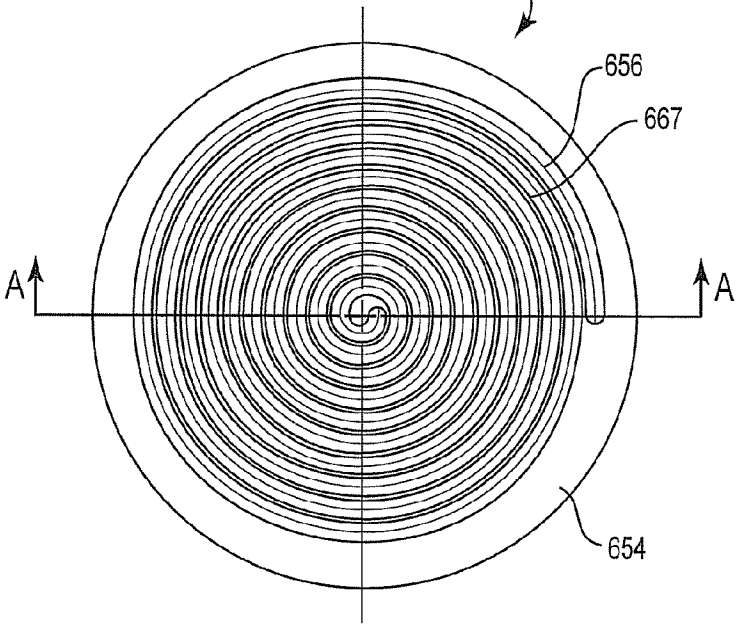
Figure 10C:
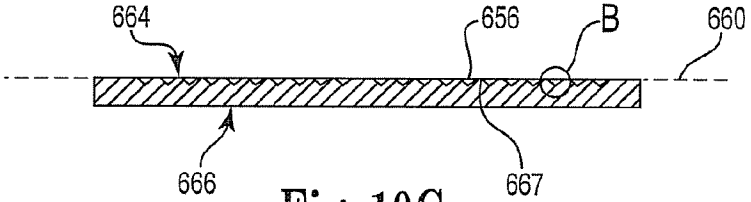

FIG. 10A is an isometric view of a bottom or underside of an alternate exemplary lid 600 of a container such as that shown in FIG. 1. FIGS. 10B-10D are a bottom view, a cross-section view taken at line A-A of FIG. 10B, and a more detailed view of a portion of the cross-section view of FIG. 10C, respectively, of the lid shown in FIG. 10A. The embodiment of the lid 600 shown in FIGS. 10A-10D is similar to that described with reference to FIGS. 9A-9C, except that the concentric circular shaped reservoirs are a single groove defined in the lid 600. In other words, a single reservoir is formed in a spiral configuration. It will be recognized that the actual number of turns of the spiral defined in lid 600 is not depicted in FIG. 10A-10B. Rather, the number of turns of the spiral may vary.

For example, the lid 600 includes a generalized engagement sealing portion 652. Further, an underside portion 664 (which may also be referred to as a bottom or lower portion) of the lid 600 is positioned adjacent the fluid composition when the lid 600 is positioned to close the holding portion (e.g., such as adjacent the fluid composition 42 if used to close holding portion 34 of container 30 as shown in FIG. 1). The underside portion 664 (e.g., which is located in the interior of the container when the container is closed) is opposite the upper or exterior portion 666 (e.g., which is on the exterior of the container when the container is closed).

The underside portion 664 and the upper or exterior portion 666 may be provided by a body of material 654. The body of material 654 defines at least one skinning plane 660. The at least one skinning plane 660 is adjacent the fluid composition 42 when the lid 600 is positioned to close the container. A single reservoir 656 (e.g., a spiral groove reservoir) is defined by one or more walls 667 of the body of material 654. In one or more embodiments, the reservoir 656 is open to receive the fluid composition 42 therein by capillary action when the lid 600 is positioned to close the container. The specific details regarding the walls and reservoir may be discerned from the other walls and reservoirs described herein and shall not be further described in detail. However, it is noted that dimensional characteristics and parameters when defined for other configurations including a plurality of reservoirs are defined with reference to adjacent reservoirs. In the embodiment of FIGS. 10A-10D, such characteristics are defined with reference to a portion of a reservoir that is adjacent another portion of the reservoir due to the existence of only a single reservoir. For example, the limited skinning surface located between adjacent reservoirs in other configurations is a limited skinning surface located between adjacent portions of a single reservoir. Again, although a V-shaped reservoir cross-section is shown in FIGS. 10A-10D, one will recognize that many various cross-section shapes (e.g., both symmetric and non-symmetric) may be used as the shape of the reservoir, and that the present disclosure is not limited to only those specifically recited or listed herein.

It will be recognized that one or more features shown in one or more embodiments of the description herein may be used in combination with one or more features of other embodiments. The present disclosure is not limited to the specific combinations of features described herein. For example, the rounded transition portions shown in the embodiment of FIGS. 4A-4E can be used in combination with walls of other configurations described herein (e.g., the walls of FIG. 7 and any other embodiment where such transitions may be beneficial).

Illustrative embodiments of this invention are discussed and reference has been made to possible variations within the scope of this invention. These and other variations, combinations, and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

The invention claimed is:

1. A container used to hold a fluid composition, the container comprising:

a holding portion to contain a fluid composition, wherein the holding portion defines an opening; and a lid to close the opening of the holding portion, wherein one or more portions of at least one of the holding portion and the lid comprise:

a body of material defining one or more skinning planes, wherein the one or more skinning planes are adjacent the fluid composition when the lid is positioned to close the container; and a plurality of reservoirs defined by a plurality of walls of the body of material, wherein each reservoir of the plurality of reservoirs is enclosed by one or more walls of the plurality of walls, wherein the one or more walls enclosing the reservoir of the plurality of reservoirs define an open end for the reservoir to receive a portion of the fluid composition into the reservoir through the open end of the reservoir and retain the portion of the fluid composition in the reservoir, wherein each wall of the plurality of walls defining the plurality of reservoirs comprises a first wall surface portion on the one or more skinning planes exposed to the fluid composition and located between adjacent reservoirs, wherein each of the plurality of reservoirs has a reservoir depth orthogonal to the one or more skinning planes capable of holding the fluid composition, wherein the reservoir depth is greater than 1 mm, and further wherein each reservoir has a width between first wall surface portions and orthogonal to the depth of the reservoir that is less than 10 mm.

2. The container of claim 1, wherein the plurality of reservoirs and the plurality of walls defining the plurality of reservoirs cover substantially all area of the lid exposed to the fluid composition.

3. The container of claim 1, wherein the plurality of reservoirs and the plurality of walls defining the plurality of reservoirs cover at least an interior portion of a base portion of the holding portion.

4. The container of claim 1, wherein the walls comprise a polygonal wall configuration defining the plurality of reservoirs.

5. The container of claim 4, wherein the walls comprise a hexagonal wall configuration defining the plurality of reservoirs.

6. The container of claim 1, wherein the walls comprise a plurality of concentric walls defining a plurality of reservoirs.

7. The container of claim 1, wherein the lid is formed of a plastic material using a mold.

8. The container of claim 1, wherein the lid is formed of a metal material by stamping.

9. The container of claim 1, wherein the fluid composition is a paint formulation prone to skinning when the fluid composition is located in a container having a lid comprising a planar underside surface adjacent the paint formulation when the lid is positioned to close the container.

10. The container of claim 9, wherein the fluid composition is a paint formulation having at least one of a viscosity in a range of 0.7 cP at room temperature to 100,000 cP at room temperature, a density in a range of 500 $kg/m^3$ to 1500 $kg/m^3$, and a liquid to air surface tension in a range of 10 mN/m to 100 mN/m.

11. A container used to hold a fluid composition, the container comprising:

a holding portion to contain a fluid composition, wherein the holding portion defines an opening; and a lid to close the opening of the holding portion, wherein one or more portions of at least one of the holding portion and the lid comprise:

a body of material defining one or more skinning planes, wherein the one or more skinning planes are adjacent the fluid composition when the lid is positioned to close the container; and a plurality of reservoirs defined by a plurality of walls of the body of material, wherein each reservoir is enclosed by one or more walls with an open end to receive and retain a portion of the fluid composition, wherein each wall of the plurality of walls defining the plurality of reservoirs comprises a first wall surface portion on the one or more skinning planes exposed to the fluid composition when the lid is positioned to close the container and having a mid-point axis orthogonal to the one or more skinning planes, the first wall surface portion being located between adjacent reservoirs, wherein each wall further comprises one or more second wall surface portions that define at least a portion of one or more of the plurality of reservoirs, wherein the first wall surface portion on the one or more skinning planes is defined by a first wall surface skinning distance that is less than 2 mm, wherein the first wall surface skinning distance is a measurement of the first wall surface on the one or more skinning planes taken along a measurement plane normal to the wall and containing the mid-point axis that is orthogonal to the one or more skinning planes.

12. The container of claim 11, wherein each of the plurality of reservoirs has a reservoir depth orthogonal to the one or more skinning planes capable of holding the fluid composition, wherein the reservoir depth is greater than 1 mm.

13. The container of claim 12, wherein each reservoir has a maximum width orthogonal to the depth of the reservoir that is less than 10 mm.

14. The container of claim 13, wherein each reservoir has a maximum width orthogonal to the depth of the reservoir that is less than 6 mm.

15. The container of claim 12, wherein each reservoir has a reservoir depth that is less than 5 mm.

16. The container of claim 11, wherein the first wall surface portion lying on the one or more skinning planes is defined by a first wall surface skinning distance that is less than 1 mm.

17. The container of claim 11, wherein all surface area of the first wall surface portions on the one or more skinning planes is less than 40 percent of a total area of the one or more skinning planes occupied by both the first wall surface portions and the one or more reservoirs.

18. The container of claim 11, wherein each wall has a limited skinning surface located between adjacent reservoirs or adjacent portions of a reservoir that comprises at least the first wall surface portion on the one or more skinning planes, wherein the limited skinning surface is defined by a limited skinning distance that is less than 2 mm, wherein the limited skinning distance is a measurement of the wall at a cross-section thereof taken at a depth from the skinning plane of 0.25 mm or less, wherein the measurement of the wall is taken along a measurement plane normal to the wall and containing the mid-point axis that is orthogonal to the skinning plane.

19. The container of claim 11, wherein the one or more second wall surface portions that define at least a portion of the reservoirs comprise at least a rounded edge surface portion adjacent the first wall surface portion.

20. The container of claim 11, wherein the first wall surface portion comprises a planar surface portion on the one or more skinning planes.

21. A container used to hold a fluid composition, the container comprising:

a holding portion to contain a fluid composition, wherein the fluid composition contained in the holding portion presents a fluid surface, and further wherein the holding portion defines an opening; and a lid to close the opening of the holding portion, wherein the lid comprises:

a body of material defining one or more skinning planes, wherein the one or more skinning planes are adjacent the fluid composition when the lid is positioned to close the container; and one or more reservoirs defined by one or more walls of the body of material, wherein the one or more reservoirs and the one or more walls defining the one or more reservoirs cover substantially all area of the lid exposed to the fluid composition that is generally parallel to the fluid surface when the lid is positioned to close the container, wherein each reservoir is open to receive and retain a portion of the fluid composition therein when the lid is positioned to close the container, wherein each wall of the one or more walls defining the one or more reservoirs comprises a first wall surface portion on the one or more skinning planes exposed to the fluid composition when the lid is positioned to close the container and having a mid-point axis orthogonal to the one or more skinning planes, the first wall surface portion being located between adjacent reservoirs or between adjacent portions of a reservoir, wherein each wall further comprises one or more second wall surface portions that define at least a portion of the one or more reservoirs, wherein the first wall surface portion on the one or more skinning planes is defined by a first wall surface skinning distance that is less than 2 mm, wherein the first wall surface skinning distance is a measurement of the first wall surface on the one or more skinning planes taken along a measurement plane normal to the wall and containing the mid-point axis that is orthogonal to the one or more skinning planes, and further wherein each of the one or more reservoirs has a reservoir depth orthogonal to the one or more skinning planes capable of holding the fluid composition, wherein the reservoir depth is greater than 1 mm.

22. The container of claim 21, wherein each reservoir has a maximum width orthogonal to the depth of the reservoir that is less than 10 mm.

23. The container of claim 21, wherein each reservoir has a reservoir depth that is less than 5 mm.

24. The container of claim 21, wherein all surface area of the first wall surface portions on the one or more skinning planes is less than 40 percent of a total area of the one or more skinning planes occupied by both the first wall surface portions and the one or more reservoirs.

25. The container of claim 21, wherein the walls comprise a polygonal wall configuration defining a plurality of reservoirs.

26. The container of claim 21, wherein the walls comprise a hexagonal wall configuration defining the plurality of reservoirs.

27. The container of claim 21, wherein the one or more walls comprise a spiral wall defining a single continuous reservoir.

28. A lid for a container used to hold a fluid composition, the lid comprising:

a body of material defining one or more skinning planes, wherein the one or more skinning planes are adjacent a fluid surface of the fluid composition when the lid is positioned to close the container; and one or more reservoirs defined by one or more walls of the body of material, wherein the one or more reservoirs and the one or more walls defining the one or more reservoirs cover substantially all area of the lid exposed to the fluid composition that is generally parallel to the fluid surface when the lid is positioned to close the container, wherein each reservoir is open to receive and retain a portion of the fluid composition therein when the lid is positioned to close the container, wherein each wall of the one or more walls defining the one or more reservoirs comprises a first wall surface portion on the one or more skinning planes exposed to the fluid composition when the lid is positioned to close the container and having a mid-point axis orthogonal to the one or more skinning planes, the first wall surface portion being located between adjacent reservoirs or between adjacent portions of a reservoir, wherein each wall further comprises one or more second wall surface portions that define at least a portion of the one or more reservoirs, wherein the first wall surface portion on the one or more skinning planes is defined by a first wall surface skinning distance that is less than 2 mm, wherein the first wall surface skinning distance is a measurement of the first wall surface on the one or more skinning planes taken along a measurement plane normal to the wall and containing the mid-point axis that is orthogonal to the one or more skinning planes, and further wherein each of the one or more reservoirs has a reservoir depth orthogonal to the one or more skinning planes capable of holding the fluid composition, wherein the reservoir depth is greater than 1 mm.

29. The lid of claim 28, wherein each reservoir has a maximum width orthogonal to the depth of the reservoir that is less than 10 mm.

30. The lid of claim 28, wherein each reservoir has a reservoir depth that is less than 5 mm.

31. The lid of claim 28, wherein all surface area of the first wall surface portions on the one or more skinning planes is less than 40 percent of a total area of the one or more skinning planes occupied by both the first wall surface portions and the one or more reservoirs.

32. The lid of claim 28, wherein the walls comprise a polygonal wall configuration defining a plurality of reservoirs.

33. The lid of claim 28, wherein the walls comprise a hexagonal wall configuration defining the plurality of reservoirs.

34. A container used to hold a fluid composition, comprising:

a holding portion to contain a fluid composition, wherein the holding portion defines an opening; and a lid to close the opening of the holding portion, wherein one or more interior portions of the holding portion comprise:

a body of material defining one or more skinning planes, wherein the one or more skinning planes are adjacent a fluid surface of the fluid composition; and one or more reservoirs defined by one or more walls of the body of material, wherein each reservoir is open to receive and retain a portion of the fluid composition therein, wherein each wall of the one or more walls defining the one or more reservoirs comprises a first wall surface portion on the one or more skinning planes exposed to the fluid composition and having a mid-point axis orthogonal to the one or more skinning planes, the first wall surface portion being located between adjacent reservoirs or between adjacent portions of a reservoir, wherein each wall further comprises one or more second wall surface portions that define at least a portion of the one or more reservoirs, wherein the first wall surface portion on the one or more skinning planes is defined by a first wall surface skinning distance that is less than 2 mm, wherein the first wall surface skinning distance is a measurement of the first wall surface on the one or more skinning planes taken along a measurement plane normal to the wall and containing the mid-point axis that is orthogonal to the one or more skinning planes, and further wherein each of the one or more reservoirs has a reservoir depth orthogonal to the one or more skinning planes capable of holding the fluid composition, wherein the reservoir depth is greater than 1 mm.

35. The container of claim 34, wherein the one or more reservoirs and the one or more walls defining the one or more reservoirs cover at least an interior portion of a base portion of the holding portion.

36. The container of claim 34, wherein each reservoir has a maximum width orthogonal to the depth of the reservoir that is less than 10 mm.

37. The container of claim 34, wherein each reservoir has a reservoir depth that is less than 5 mm.

38. The container of claim 34, wherein all surface area of the first wall surface portions on the one or more skinning planes is less than 40 percent of a total area of the one or more skinning planes occupied by both the first wall surface portions and the one or more reservoirs.

* * * * *